US006373510B1

(12) United States Patent
Hosokawa et al.

(10) Patent No.: US 6,373,510 B1
(45) Date of Patent: Apr. 16, 2002

(54) TAPE PRINTING APPARATUS AND METHOD OF FORMING PRINT IMAGE FOR TAPE

(75) Inventors: Takeshi Hosokawa, Shiojiri; Kenji Watanabe, Tokyo; Tomoyuki Ichikawa, Tokyo; Kenichi Tanabe, Tokyo; Rie Sudo, Tokyo, all of (JP)

(73) Assignees: Seiko Epson Corporation; King Jim Co., Ltd., both of Tokyo (JP)

( * ) Notice: Subject to any disclaimer, the term of this patent is extended or adjusted under 35 U.S.C. 154(b) by 0 days.

(21) Appl. No.: 09/276,033

(22) Filed: Mar. 25, 1999

(30) Foreign Application Priority Data

Mar. 27, 1998 (JP) ..... 10-100210

(51) Int. Cl.[7] ..... B41J 2/32
(52) U.S. Cl. ..... 347/171; 400/61
(58) Field of Search ..... 347/171; 400/61

(56) References Cited

U.S. PATENT DOCUMENTS 5,322,375 A * 6/1994 Niwa et al. ..... 400/61

FOREIGN PATENT DOCUMENTS

JP 07-266628 * 10/1995

* cited by examiner

*Primary Examiner*—Huan Tran
(74) *Attorney, Agent, or Firm*—Hogan & Hartson L.L.P.

(57) ABSTRACT

There are provided a tape printing apparatus and a method of forming a print image for a tape. A basic image is deformed in the direction of width of a tape, based on a specific modification pattern, and then the deformed basic image is printed on the tape. Modifying data of the modification pattern is stored in a memory device. The basic image data representative of the basic image is developed into a dot matrix corresponding to a print area of the tape. Each dot of each dot line of the basic image data developed into the dot matrix, the each dot line extending in the direction of the width of the tape, is shifted in a direction corresponding to the direction of width of the tape, based on the modification pattern to thereby form the print image.

14 Claims, 16 Drawing Sheets

SHIFT AMOUNT S 0 1 1 2 2 1 1 0 0 -1 -1 -2 -2 -1 -1 0

SHIFT AMOUNT S 0 1 2 3 4 3 2 1 0 1 2 3 4 3 2 1 0 1

SHIFT AMOUNT S 0 1 2 · · · · · · · · · 0 1 2 3 · · · · ·

W-1

W-2

TAPE PRINTING APPARATUS AND METHOD OF FORMING PRINT IMAGE FOR TAPE

BACKGROUND OF THE INVENTION

1. Field of the Invention

This invention relates to a tape printing apparatus and a method of forming a tape print image, which are capable of deforming an image to be printed, in the direction of width of a tape and then printing the deformed image on the tape.

2. Prior Art

Conventionally, a tape printing apparatus is capable of decorating an entered image such as characters by the use of various methods such as "italicization", "emphasis", "hollow characters", etc. and then printing the decorated image on a tape as a printing medium, thereby enabling creation of labels picturesque and rich in variety. A character image to be printed is formed of a dot matrix. The character image has image portions formed of positive dots and blank portions formed of negative dots. Therefore, when decoration by "italicization" (hereinafter referred to as "italic decoration") is set for decorating the character image, the positive dots are shifted in longitudinal directions of the tape by predetermined amounts to deform the character image in this direction, and then the deformed image is printed on the tape.

As described above, as far as the decoration of an image carried out by the conventional tape printing apparatus, especially the decoration by deforming an image, such as italic decoration, is concerned, the image is always deformed along the length of the tape. That is, the conventional tape printing apparatus assumes that a character string extends linearly, which makes it impossible to carry out printing of images rich in variety, such as images having undulations, etc.

SUMMARY OF THE INVENTION

It is a first object of the invention to provide a tape printing apparatus which is capable of deforming an image in the direction of width of a tape, thereby allowing creating of labels richer in variety.

It is a second object of the invention to provide a method of forming an image, which enables deformation of an image in the direction of width of a tape, thereby allowing creation of labels richer in variety.

To attain the first object, according to a first aspect of the invention, there is provided a tape printing apparatus for deforming a basic image in the direction of width of a tape, based on a specific modification pattern, and then printing the deformed basic image on the tape.

The tape printing apparatus according to the first aspect of the invention is characterized by comprising:

modification pattern storage means for storing modifying data of the modification pattern;

data-developing means for developing basic image data representative of the basic image into a dot matrix corresponding to a print area of the tape; and print image-forming means for forming a print image from the basic image by shifting each dot of each dot line of the basic image data developed into the dot matrix, the each dot line extending in a direction corresponding to the direction of the width of the tape, in the direction corresponding to the direction of the width of the tape, based on the modification pattern.

To attain the second object, according to a second aspect of the invention, there is provided a method of forming a print image to be printed on a tape, the method comprising the steps of:

developing basic image data representative of a basic image into a dot matrix corresponding to a print area of the tape: and shifting each dot of each dot line of the basic image data developed into the dot matrix, the each dot line extending in a direction corresponding to a direction of the width of the tape, in the direction corresponding to the direction of the width of the tape, based on a specific modification pattern, to thereby form the print image.

According to the tape printing apparatus and the method, data of a basic image (basic image data) is developed into a predetermined dot matrix, and each dot of each dot line forming part of the basic image data and extending in a direction corresponding to the direction of width of a tape is shifted in the direction along the dot line, based on a specific modification pattern. Therefore, it is possible to form a print image (tape print image) obtained by deforming the basic image in the direction of width of the tape.

Preferably, the print image-forming means includes image correction means for scaling down the basic image, the image correction means scaling down the basic image in a manner such that the print image is fitted in the print area if the print image extends off the print area of the tape.

According to this preferred embodiment, the correction means scales down to the basic image to a predetermined size when the print image extends off a print area of the tape (in the direction of width of the tape). This enables the print image to be adjusted in size so as to be fitted in the print area, and thereby enhance the appearance of the print image. The basic image may be reduced in size only in the direction corresponding to the direction of width of the tape instead of reducing the whole thereof.

Preferably, the print image-forming means includes dot-shifting means for shifting the each dot of each dot line of the dot matrix in a state of both ends of the each dot line being imaginarily linked to each other, the data-shifting means circularly moving dots forming portions of the print image outside the print area of the tape if the print image extends off the print area.

According to this preferred embodiment, each dot of each dot line of the dot matrix is shifted in a state of both ends of the dot line being imaginarily linked to each other, so that if the print image extends off a print area of the tape, dots forming portions of the print image which spread outward from one side of the print area are circularly moved. This enables the portions of the image to be formed in an opposite side portion of the print area. Therefore, even if a character image or the like extends off a print area of the tape, for instance, a portion of the character image lying out of the print area can be printed at a predetermined location in the print area, so that it is possible to recognize the character image based on the thus modified image.

Preferably, the print image-forming means includes image correction means for scaling down the basic image, the image correction means scaling down the basic image in a manner such that the print image is fitted in the print area if the print image extends off the print area of the tape, and dot-shifting means for shifting the each dot of each dot line of the dot matrix in a state of both ends of the each dot line being imaginarily linked to each other, the data-shifting means circularly moving dots forming portions of the print image outside the print area of the tape if the print image extends off the print area, and the tape printing apparatus includes function selection means for selecting between an image-correcting function performed by the image correction means and a dot-shifting function performed by the dot-shifting means.

According to this preferred embodiment, the user can selectively employ the predetermined image-correcting function and the dot-shifting function. This makes it possible to form a print image with a high degree of freedom.

Preferably, the modification pattern storage means stores modifying data of a plurality of modification patterns, the tape printing apparatus further including modification pattern selection means for selecting the specific modification pattern from the modification patterns as desired.

According to this preferred embodiment construction, the user can select the specific modification pattern from a plurality of modification patterns as desired. This allows a print image which suits the user's preference to be easily printed with a high degree of freedom.

More preferably, the modification patterns include a pattern for deforming the whole of the basic image into a wavy shape in which the basic image is undulated in the direction of the width of the tape.

According to this preferred embodiment, it is possible to undulate the whole of a print image to thereby transform the print image to one effectively expressing its contents. For instance, if an image of a song title on a stave is processed to be undulated, a print image giving a melodious impression can be obtained.

More preferably, the modification patterns include a pattern for deforming the whole of the basic image into a sawtooth shape in which the basic image is serrated in the direction of width of the tape.

According to this preferred embodiment, it is possible to serrate the whole of a print image to thereby transform the print image to one effectively expressing its contents. For instance, if an image containing a horrifying word is serrated, a print image giving a fearful impression can be obtained.

Preferably, the modifying data includes data of a maximum total shift amount by which the basic image is shifted as a whole.

According to this preferred embodiment, based on the maximum total shift amount, it is possible to scale down the basic image.

More preferably, the maximum total shift amount is set according to the width of the tape.

According to this preferred embodiment, it is possible to set the maximum total shift amount in advance for the dots of each dot line according to the width of each tape, i.e. according to the tape types having respective different tape widths, thereby enabling each print image to be formed to have a size suitable for each tape type.

Preferably, the modifying data comprises data defining a shift amount by which the each dot of the each dot line is shifted in the direction corresponding to the direction of the width of the tape.

More preferably, the data defining the shift amount comprises an equation for calculating the shift amount for the each dot line.

Alternatively, the data defining the shift amount comprises a table of data of the shift amount associated with the each dot line of the basic image data.

More preferably, the data-developing means comprises a print buffer for storing data of the each dot of the each dot line of the basic image, and the print image-forming means comprises reading means for reading the data of the each dot from an address of the print buffer shifted from an original address in an amount corresponding to the shift amount, and a modifying buffer for storing the data of the each dot read from the address of the print buffer by the reading means.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof. A tape printing apparatus of the embodiment is a thermal transfer type that carries out printing of desired characters and the like entered via a keyboard thereof on a tape by a thermal transfer printing method and then cuts off the printed portion of the tape to thereby make a label.

Figure 1:
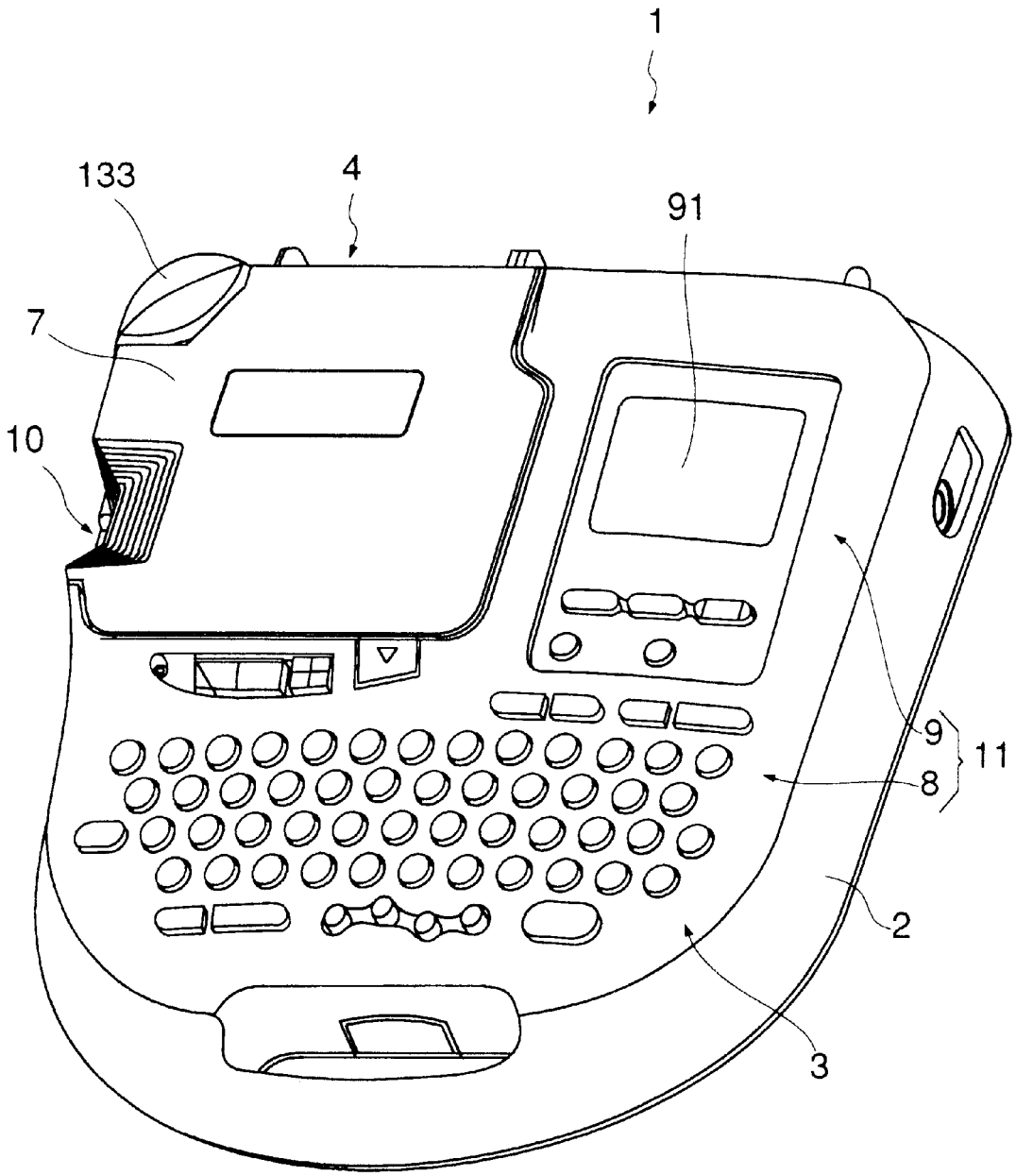
FIG. 1 is a perspective view showing an appearance of a tape printing apparatus according to an embodiment of the invention.
Figure 2:
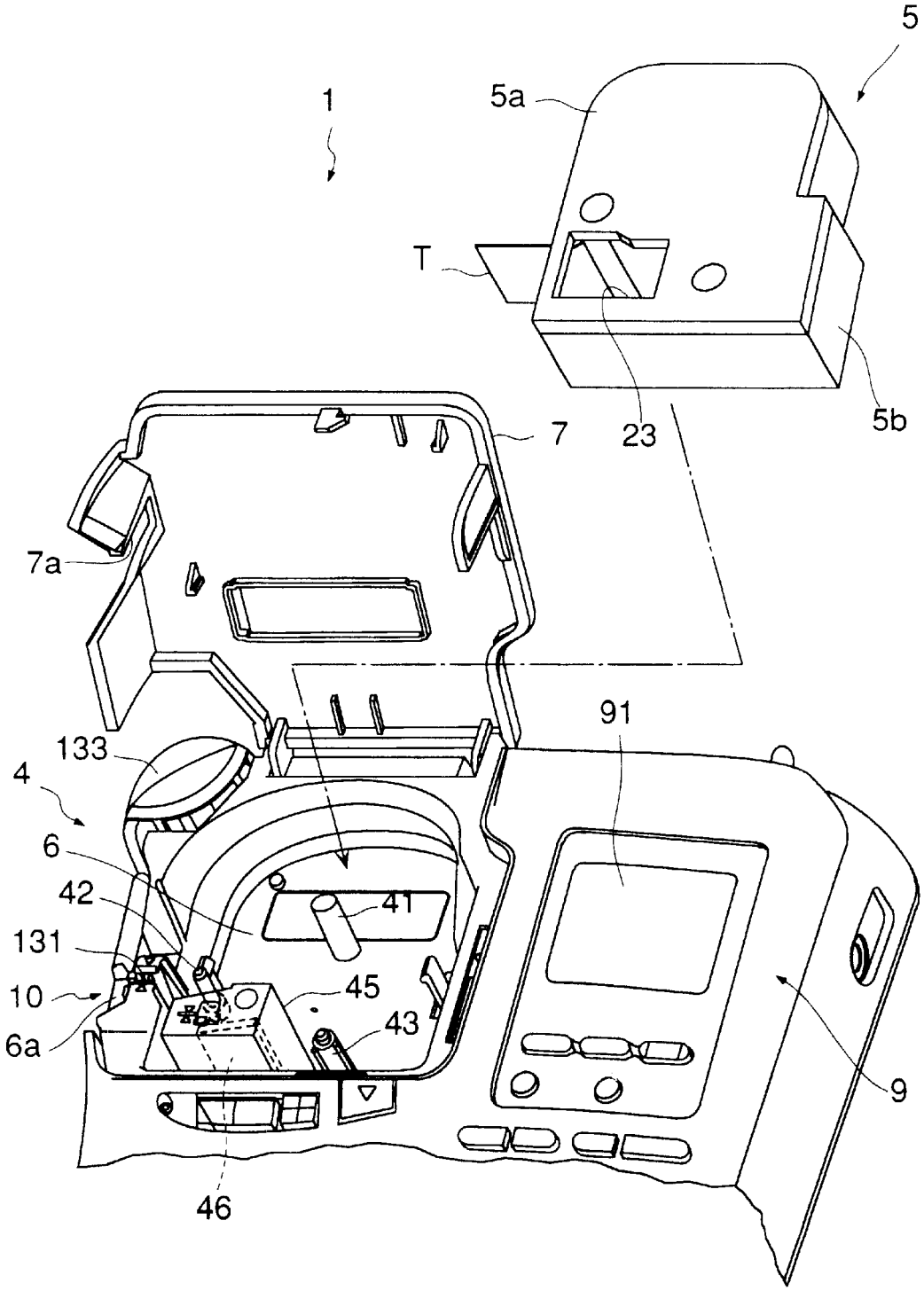
FIG. 2 is a perspective view showing a compartment of the FIG. 1 tape printing apparatus and component parts associated with the compartment.

Referring first to FIG. 1, the tape printing apparatus 1 includes a casing 2 having upper and lower divisional portions, an electronic block 3 arranged in the form of an inverted L-shape from a front half portion of the apparatus 1 to a rear right half portion of the same, and a mechanical block 4 arranged in a rear left half portion of the apparatus 1. As shown in FIG. 2, the mechanical block 4 is comprised of a compartment 6 for receiving therein a tape cartridge 5 and a lid 7 for opening and closing the compartment 6, which is formed with a window. The lid 7 has a left side wall thereof formed with an inverted U-shaped opening 7*a,* while the compartment 6 has a left side wall thereof formed with a U-shaped opening 6*a*. The two openings 6*a* and 7*a* form a tape exit 10 through which a printed tape T is sent out of the tape printing apparatus 1.

Figure 4:
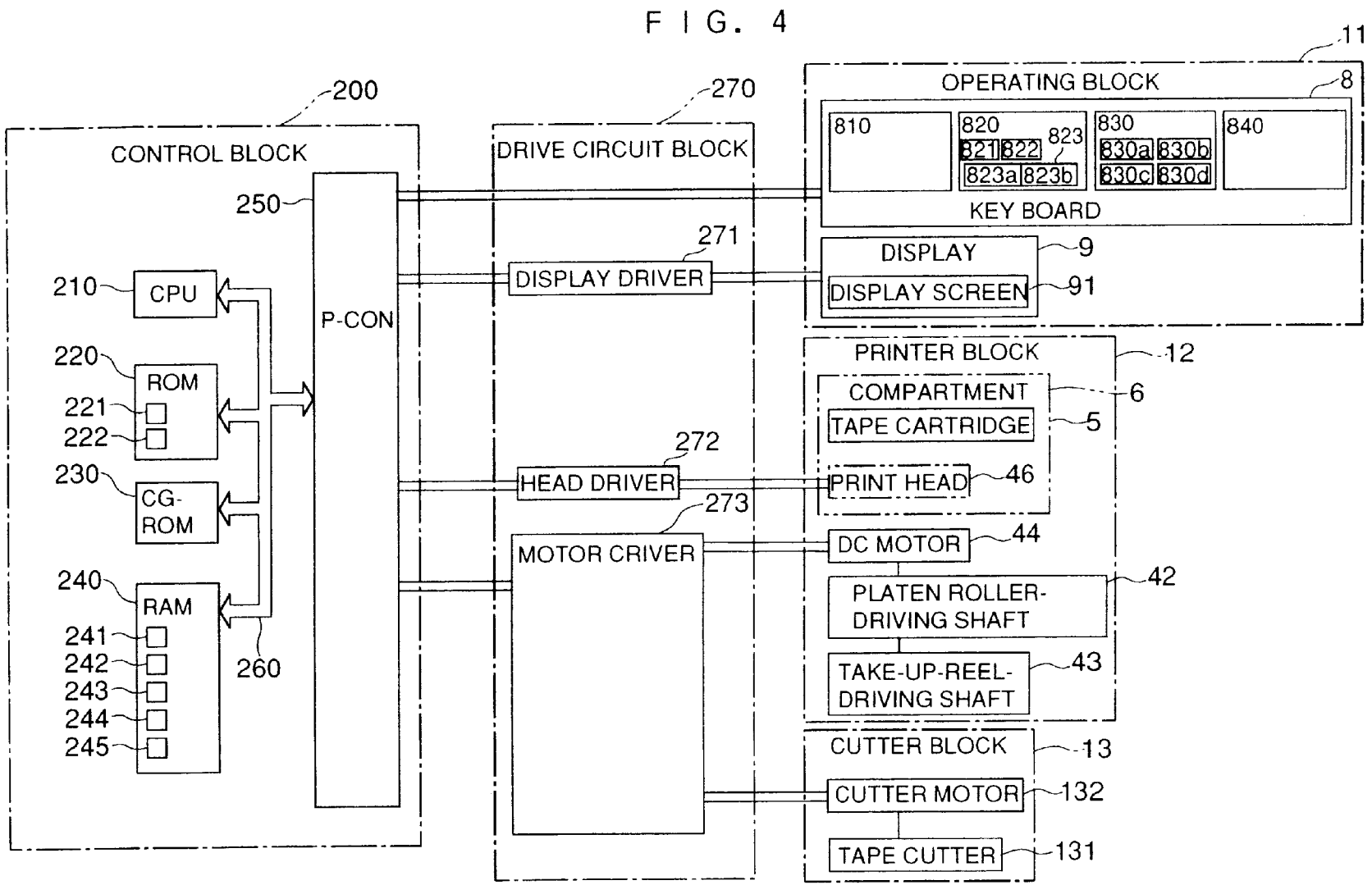
FIG. 4 is a block diagram schematically showing a control system of the FIG. 1 tape printing apparatus.

The electronic block 3 has an operating block 11 formed on a top thereof and includes a control block 200, referred to hereinbelow (see FIG. 4). The operating block 21 includes a key board 8 connected to a peripheral control circuit (P-CON) 250 of the control block 200, and a display 9 connected to the P-CON 250 via a display driver 271 of a driving circuit 270, referred to hereinafter.

On the keyboard 8, there are arranged a character key group 810 including a lot of keys 810 for use in entering characters such as letters, symbols and simple figures and a function key group 820 for use in giving instructions for editing, printing, etc. of the entered characters. The function key group 820 includes cursor keys 830 (left arrow key 830*a,* right arrow key 830*b,* up arrow key 830*c,* and down arrow key 830*d*) for moving a cursor on the display 9, a selection key 840 for selecting a desired one out of a plurality of options, and so forth. The display 9 has a rectangular display screen 91 on which are displayed images of entered characters as well as various operational modes and options to be selected during editing and printing of the images.

Next, description will be made of a printing block 12 which carries out printing on the tape T of the tape cartridge 5. The tape cartridge 5 is constructed such that it is removable from the mechanical block 4, and it is replaceable together with a casing thereof when the ink ribbon C is used up. Further, as the tape cartridge 5, there are supplied various types which contain tapes T different in width or color.

Figure 3:
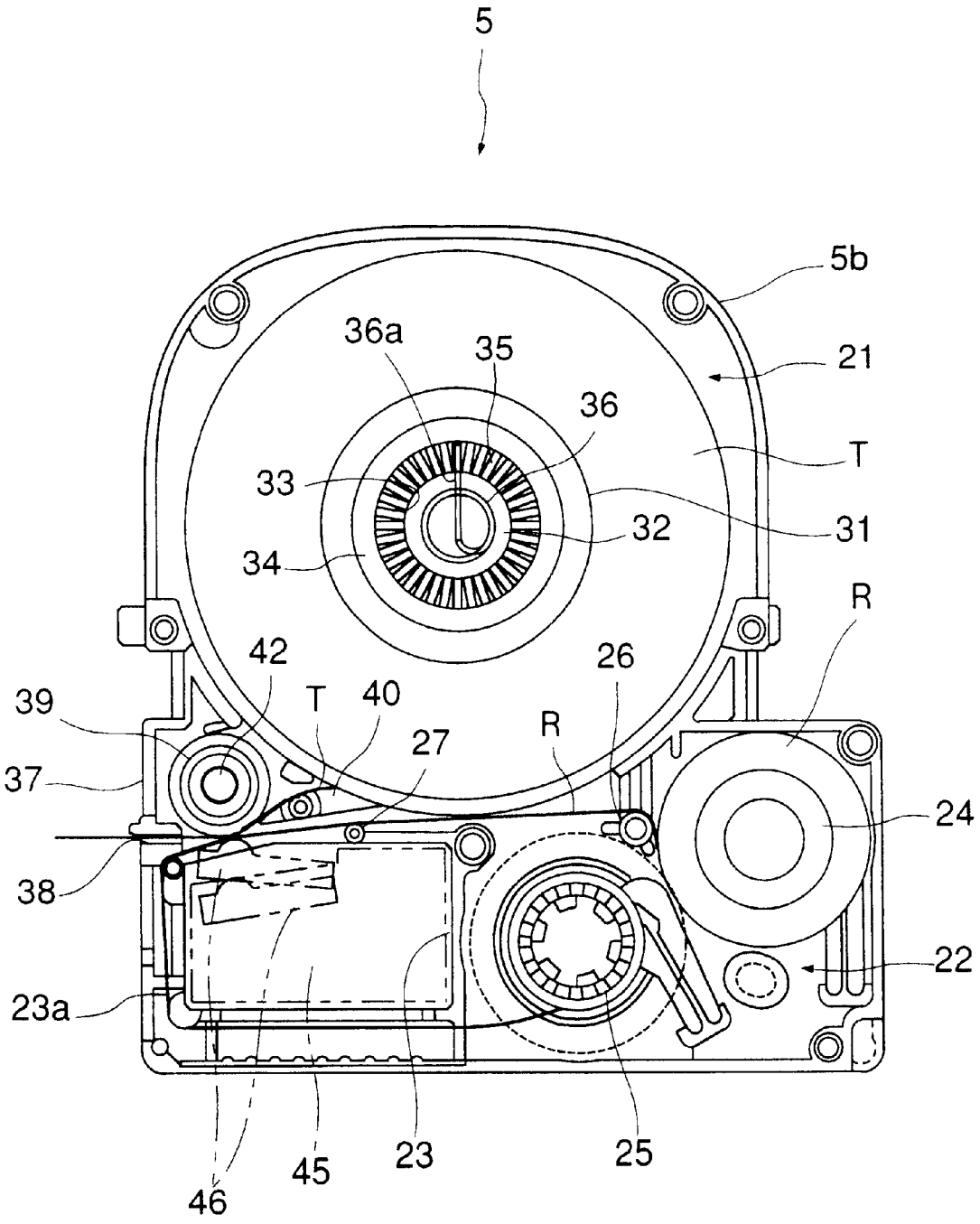
FIG. 3 is a plan view showing an internal construction of a tape cartridge.

FIG. 3 shows the tape cartridge 5 from which an upper casing thereof is removed. The tape cartridge 5 has a casing comprised of the upper casing 5*a* (see FIG. 2) and a lower casing 5*b*. The inside of the casing is divided into a tape-holding block 21 for holding the tape T therein and an ink ribbon-holding block 22 for holding an ink ribbon R therein. The ink ribbon-holding block 22 is formed with a rectangular head opening 23 through which a head unit 45 having a print head 46, described hereinafter, is fitted in when the tape cartridge 5 is mounted in the compartment 6.

The ink ribbon-holding block 22 contains a ribbon supply reel 24 around which the ink ribbon R is wound, and a ribbon take-up reel 25 for taking up used part of the ink ribbon R therearound, each arranged in a rotatable manner. The ink ribbon R rolled out from the ribbon supply reel 24 is guided by a first guide pin 26 and a second guide pin 27 to a platen roller 39, referred to hereinafter, and then makes a U-turn in a manner traveling along a peripheral wall 23*a* of the head opening 23 to be taken up by the ribbon take-up reel 25.

The tape-holding block 21 formed to have a generally circular shape has a cylindrical reel support portion 32 formed at a central portion thereof in the lower casing 5*b* in a protruding manner, for rotatably supporting a tape reel 31 around which the tape T is wound. The tape reel 31 has a cylindrical shape, and a rib 34 having a through hole 33 extending therethrough is formed on an inner peripheral wall of the tape reel 31 at a central portion along the thickness of the reel 31. The rim of the rib 34 surrounding the through hole 33 is formed with numerous projections 35 continuously arranged to form a generally annular shape.

The tape reel 32 constructed as above is loosely fitted over the reel support portion 32 having a coiled spring 36 fitted therein from above. The coiled spring 36 has one end (upper end) thereof abutting an inner surface of the upper casing 5*a* and another end (lower end) 36*a* thereof bent in a manner crossing the reel support 32. An extreme end of the lower end 36*a* reaches into the projections 35 of the rib 34 through a cutaway portion formed in an upper end of the support portion 32. When the tape cartridge 5 is not mounted in the apparatus body, the extreme end of the lower end 36*a* of the coiled spring 36 is caught between the projections 35, 35. This engagement of the lower end 36*a* of the coiled spring 36 with the projections 35 prohibits the tape reel 31 from moving, thereby preventing the tape T from sagging due to rotation of the tape reel 31 when the tape cartridge is not loaded in the apparatus body.

At an end of a boundary between the tape-holding block 21 and the ink ribbon-holding block 22 in a side wall of a casing 37, there is formed a tape exit 38 in the form of a slit through which the tape T is sent out of the tape-holding block 21. Further, the platen roller 39 is rotatably arranged at the vicinity of the tape exit 38 in a downstream portion of the tape-holding block 21, where the tape T and the ink ribbon R are placed one upon the other and printing is carried out by pressing the print head 46 against the ink ribbon R. At a location remote from the tape exit 38 with respect to the platen roller 39 is formed a curved guide portion 40 via which the tape T is guided to the platen roller 39 for sliding contact therewith and sent out through the tape exit 38.

On the other hand, in the compartment 6 for receiving the tape cartridge 5, there is formed a positioning pin 41 projecting upward as shown in FIG. 2. The positioning pin 41 is fitted into the reel support portion 32 of the lower casing 5*b* from below to thereby facilitate proper mounting of tape cartridge 5 in the compartment 6. When the tape cartridge 5 is loaded in the compartment 6, an upper end of the positioning pin 41 urges the lower end 36*a* of the coiled spring 36 upward, whereby the lower end 36*a* is disengaged from the projections 35 of the rib 34 to permit free rotation of the tape reel 31 for smooth feeding of the tape T.

Further, in the compartment 6, there are provided a platen roller-driving shaft 42 and a ribbon take-up reel-driving shaft 43 in a manner extending perpendicularly from the bottom of the compartment 6. The platen roller-driving shaft 42 engages with the platen roller 39 to drive the same for rotation, while the ribbon take-up reel-driving shaft 43 engages with the ribbon take-up reel 25 to drive the same for rotation. The platen roller-driving shaft 42 and the ribbon take-up reel-driving shaft 43 are operated by a DC motor 44 (see FIG. 4) via a reduction gear train not shown. During printing, the shafts 42 and 43 each rotate by a predetermined amount to feed the tape T and the ink ribbon R by a corresponding predetermined amount, respectively.

As shown in FIG. 2, the head unit 45 accommodates the print head 46 comprised of a thermal head. The print head 46 can move between an original or waiting position thereof and a printing position in which it presses the tape T and the ink ribbon R against the platen roller 39. More specifically, the print head 46 is held in the original or waiting position when printing is not carried out, and is moved to the printing position in response to a print command to effect a predetermined print on the tape T based on print data supplied to the print head 46 via the P-CON 250 and a head driver 272.

Next, a cutting block 13 for cutting off the printed portion of the tape T will be described. The cutting block 13 includes a tape cutter 131 provided on a compartment side of the tape exit 10 for cutting the tape T and a cutter motor 132 for driving the tape cutter 131 for a cutting operation. When a printing process is terminated, the tape T is further fed by a predetermined amount, and then stopped, whereupon the cutter motor 132 starts driving the tape cutter 131 for cutting off the printed portion of the tape T automatically (automatic cutting). In the tape printing apparatus 1, it is also possible to cancel an automatic cutting mode and cut the tape T manually. In this case, when the tape T is sent out by a predetermined amount after completion of printing, a cutting button 133 arranged in a rear left corner of the tape printing apparatus 1 is depressed so as to drive the tape cutter 131 for cutting operation (manual cutting).

Next, a basic construction of a control system of the tape printing apparatus 1 will be described with reference to FIG. 4. As shown in the figure, in the tape printing apparatus 1, the control block 200 controls the display 9, the printing block 12, and the cutting block 13, via the driving circuit 270 in response to input signals from the keyboard 8. The control block 200 includes a CPU 210, a ROM 220, a character generator ROM (CG-ROM) 230, a RAM 240 and the P-CON 250, all of which are connected to each other by a bus 260.

The ROM 220 includes a control program memory area 221 storing control programs executed by the CPU 210, a control data memory area 222 storing various control data items, and so forth. The CG-ROM 230 stores font data of characters, such as letters, symbols and graphics, provided for the tape printing apparatus 1, and outputs corresponding font data when code data identifying a character is given thereto.

The RAM 240 is used as a work area for carrying out control processes. The RAM 240 includes a register group 241, a text data memory area 242 for storing text data entered by the user via the keyboard 8, a display image data memory area 243 for storing image data corresponding to contents displayed on the display screen 91, a print buffer 244 which is an area for forming an image to be printed on the tape T (i.e. a print image), and a one-line buffer 245 which is an area for temporarily storing data of each dot line, referred to hereinbelow, of the image formed in the print buffer 244. The RAM 240 is supplied with power by a backup circuit, not shown, even when the power is turned off, so as to preserve stored data therein.

The P-CON 250 includes a logical circuit comprised of a gate array, a custom LSI, etc. for complementing the function of the CPU 210 as well as dealing with signals for interface with peripheral circuits. The P-CON 250 is connected to the keyboard 8 and various sensors, not shown, for delivering various commands and input data from the keyboard 8 and various detection signals from the sensors to the CPU 210 or the RAM 240 via the bus 260, after processing or without any processing. The P-CON 250 also delivers data and control signals received from the CPU 210, etc. via the bus 260, to the driving circuit 270 after processing or without any processing.

The driving circuit 270 is comprised of the display driver 271, the head driver 272, and a motor driver 273. The display driver 271 controls the display screen 91 in response to control signals outputted from the control block 200. Similarly, the head driver 272 drives the print head 46 in accordance with instructions from the control block 200. Further, the motor driver 273 drives the DC motor 44 of the print block 12 to control the platen roller-driving shaft 42 and the take-up reel-driving shaft 43 and at the same time drives the cutter motor 132 of the cutting block 13 to control the tape cutter 131.

In the control system configured as above, the CPU 210 receives via the P-CON 250 various commands and data items entered via the keyboard 8 in accordance with control programs read out from the ROM 220, processes font data from the CG-ROM 230 and various data items stored in the RAM 240, and delivers control signals to the driving circuit 270 via the P-CON 250 to thereby carry out print control and display control of the display screen 91, and at the same time control the print head 46 to cause the same to carry out printing on the tape T under predetermined printing conditions. In short, the CPU 210 controls the overall operation of the tape printing apparatus 1.

In the case of the tape printing apparatus 1, the apparatus and method according to the present invention are implemented mainly by the operating block 11 and the control block 200. Now, features of operations executed by the tape printing apparatus 1 will be described with reference to FIGS. 5A to 18, following operating procedures up to label making.

First, when the power is turned on, the tape printing apparatus 1 is started to e placed in an operating status (operational mode) in which key entry is permitted, i.e. in an entry mode. In this entry mode, the keyboard 8 can be operated as required to enter desired characters (hereinafter referred to as "a character string" (including a case in which the character string is formed of a single character)). The printing apparatus 1 is capable of not only printing an image of an entered character string (character string image) on the tape T just as it is, but also decorating part or the whole of the character string image e.g. by the technique of "italicization", "emphasis", "hollow characters" or the like and then printing the decorated character string on the tape T. To carry out decoration of a character string, a decoration mode key 821 for changing modes is depressed to switch the operational mode from the entry mode to a decoration mode. Then, when a desired decoration is displayed by operating the cursor keys 830 (left arrow key 830*a*, right arrow key 830*b*, up arrow key 830*c*, and down arrow key 830*d*) as required, the selection key 840 is depressed to finally determine the decoration.

Further, the tape printing apparatus 1 enables setting of various outer frames each of which is used for enclosing a character string image to be printed on the tape T. To set an outer frame, a frame-setting key 822 is depressed, similarly to the case of decoration, to switch the operational mode from the entry mode to an outer frame-setting mode. Then, when a desired outer frame is displayed by operating the cursor keys 830 as required, the selection key 840 is depressed to fix the outer frame.

Printing is carried out by depressing a print key 823 when entry of a character string is completed, or after completion of setting of a decoration or an outer frame if it is desired. The tape printing apparatus 1 is provided with two kinds of print keys 820. One of them is a normal print key 823*a* for printing an entered character string on the tape T as it is (or in a decorated state e.g. if the decoration of the character string is set), and the other is a special print key 823*b* for printing a character string in a manner such that it is undulated or serrated in the direction of width of the tape T. Hereinafter, printing carried out by depressing the normal print key 823*a* is referred to as "normal printing", while printing carried out by depressing the special print key 823*b* is referred to as "special printing".

Next, description will be made of a method of printing a character string image of an entered character string on the tape T, particularly in special printing.

Figure 5A:
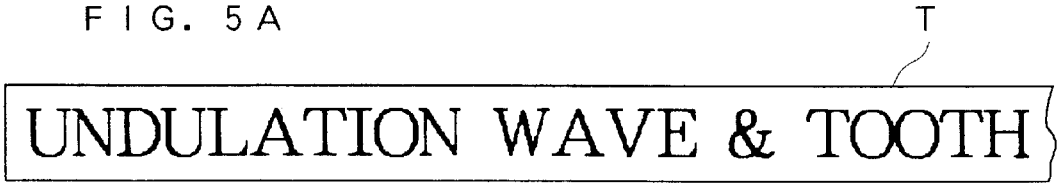
FIG. 5A shows an image printed in normal printing.
Figure 5B:
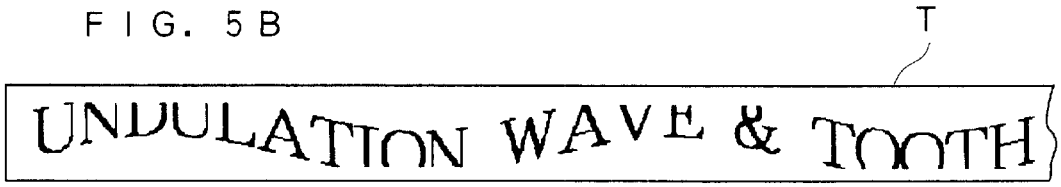
FIGS. 5B to 5E show images printed in special printing.
Figure 5C:
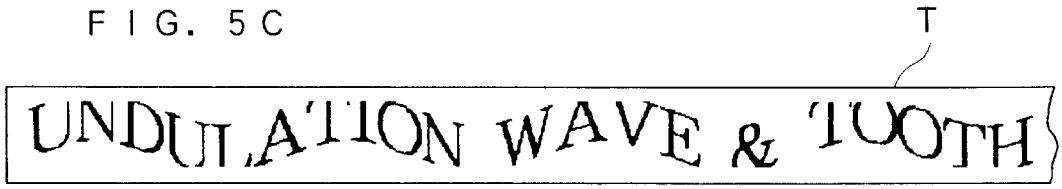
Figure 5D:
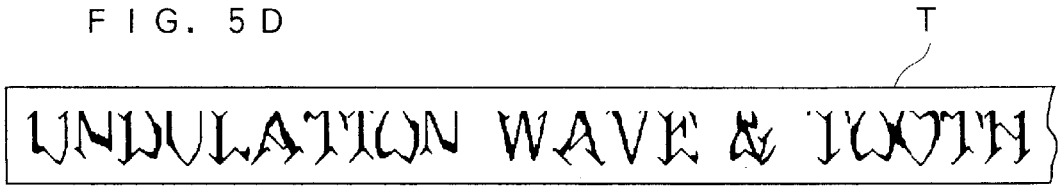
Figure 5E:
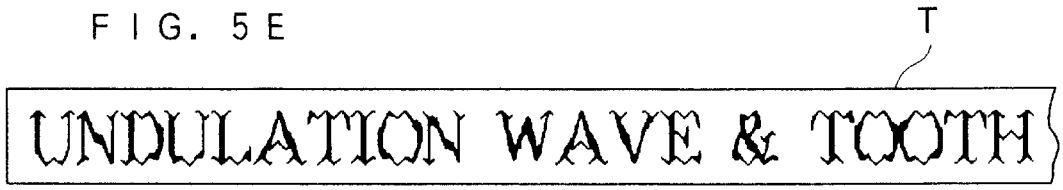

Now, let it be assumed that a character string "UNDULATION" is entered in the tape printing apparatus 1. If the character string is entered and then the normal print key 823*a* is depressed for carrying out printing (normal printing), without a decoration or an outer frame being set, an image of the character string "UNDULATION" is printed on the tape T as shown in FIG. 5A. On the other hand, after entry of the same character string, if the special print key 823*b* is depressed for carrying out printing (special printing), without a decoration or an outer frame being set, the character string image is printed in a undulated manner as shown in FIGS. 5B, 5C or in a serrated manner as shown in FIGS. 5D, 5E. Hereinafter, printing in which a character string image is printed in a undulated manner is referred to as "undulating printing", while printing in which a character string image is printed in a serrated manner is referred to as "serrating printing".

Figure 6:
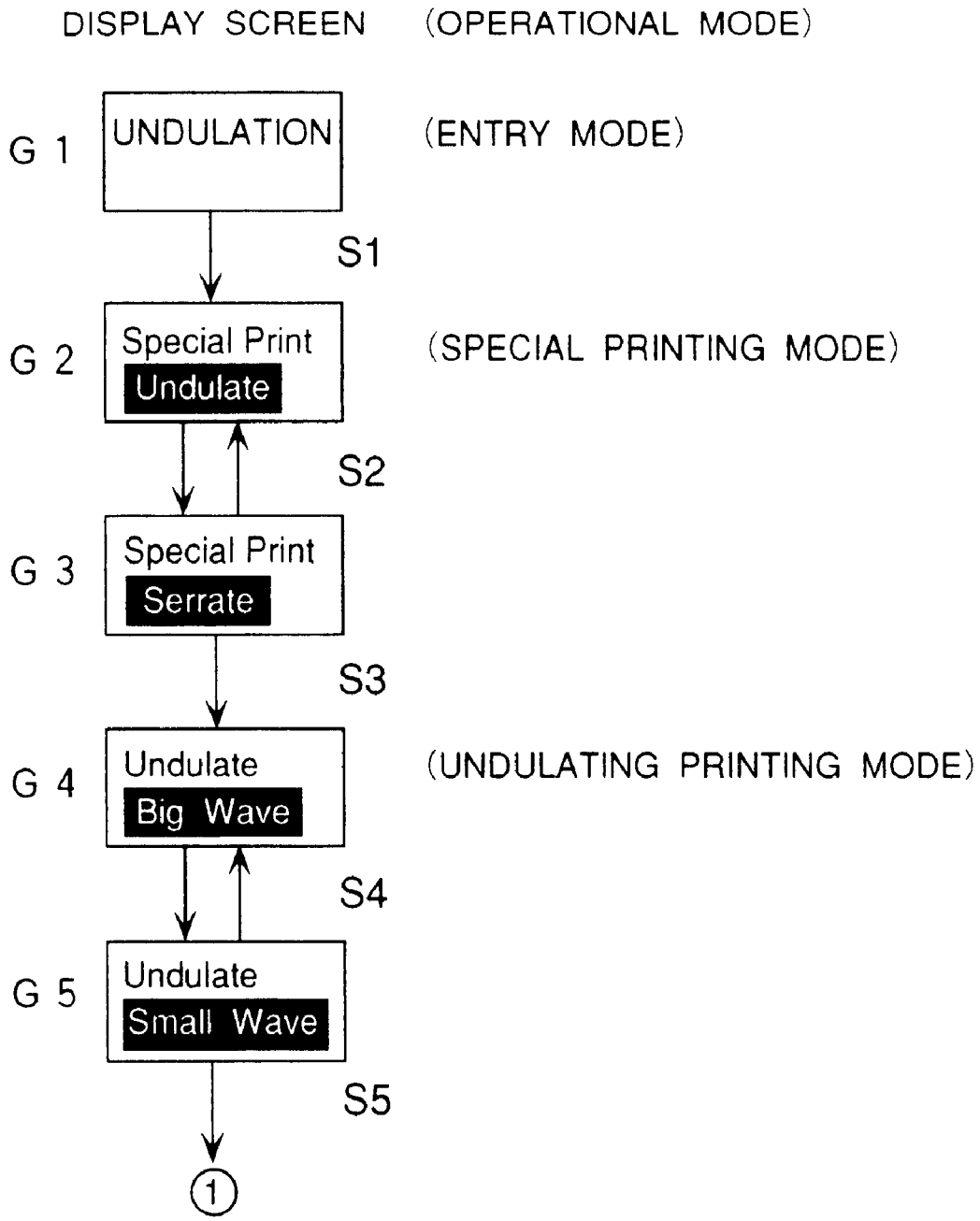
FIG. 6 is a diagram which is useful in explaining operations of a keyboard for special printing and changes in screen display corresponding to the operations.
Figure 7:
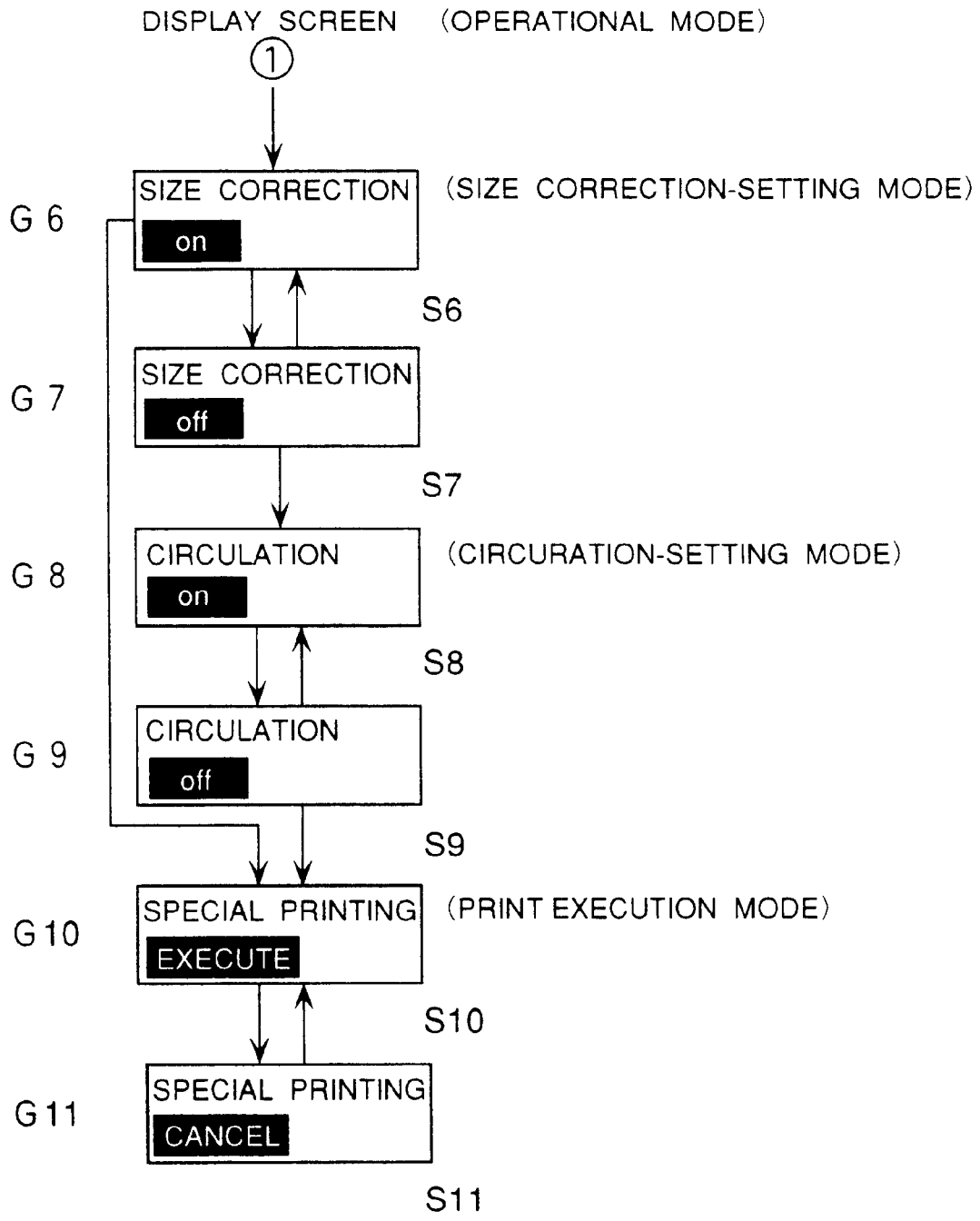
FIG. 7 is a diagram continued from FIG. 6.
Figure 8A:
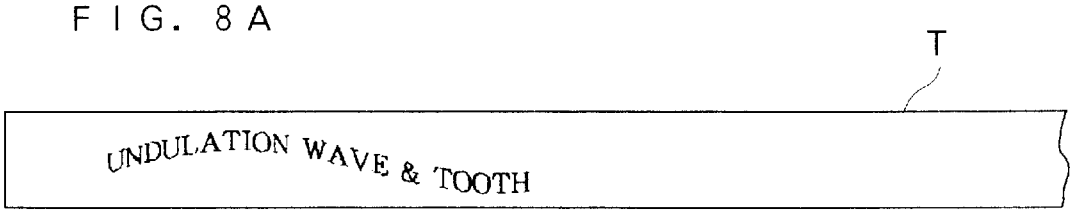
FIG. 8A shows an image printed in "undulating printing" after setting of size correction.
Figure 8B:
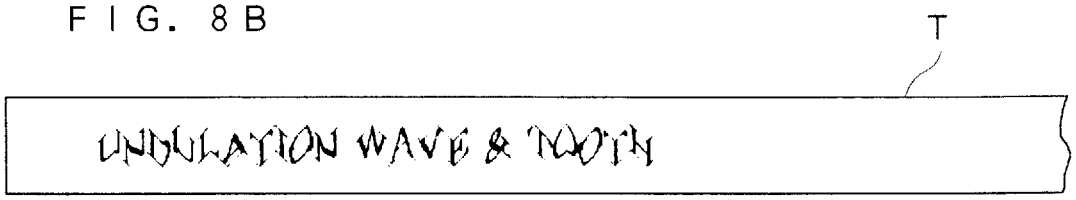
FIG. 8B shows an image printed in "serrating printing" after setting of size correction.
Figure 9A:
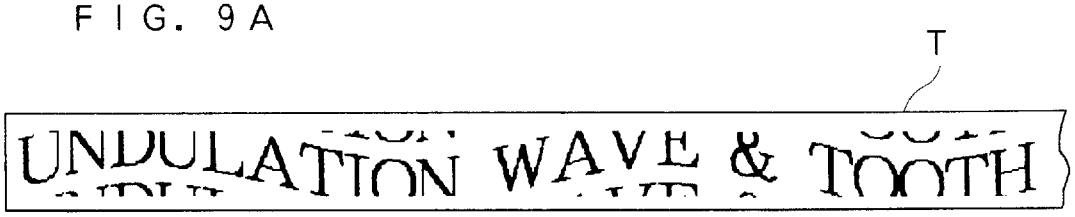
FIG. 9A shows an image printed in "undulating printing" after setting of circulation.
Figure 9B:
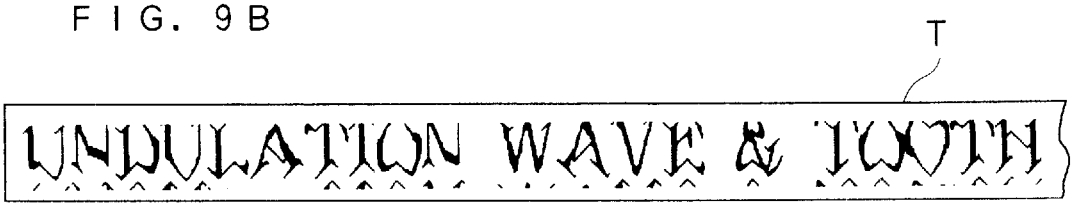
FIG. 9B shows an image printed in "serrating printing" after setting of the circulation.

FIGS. 6 and 7 are for explaining keyboard operations in the special printing and show the resulting screens of the screen display caused by the keyboard operations. In the figures, G1 to G11 each schematically show an image of a screen displayed on the display screen 91, while S1 to S11 each represent a keyboard operation described hereinbelow.

Referring to FIG. 6, when the special print key 823*b* is depressed (S1) after the character string is entered (G1), the operational mode is switched from the entry mode to a special printing mode. At this time point, "Special Print" is displayed as a title on an upper half portion of the display screen 91, and "Undulate" is displayed in reverse video on a lower half portion of the same (G2). The displayed image "Undulate" represents an option for selecting the undulating printing. Selection of the option enables the character string image to be printed in undulating printing.

Further, if the down arrow key 830*a* is depressed (S2) when the screen display displays the G2, the screen display changes to a screen G3, in which "Serrate" is displayed in reverse video in place of "Undulate". Similarly to "Undulate", the displayed image "Serrate" represents an option for selecting the serrating printing. Selection of the option enables the character string image to be printed in serrating printing.

When the screen G2 or G3 is displayed, the screen can be switched between G2 and G3 each time the down arrow key 830*d* or the up arrow key 830*c* is selectively depressed. Arrows "↓↑" in FIGS. 6 and 7 indicate that it is possible to switch the screen alternately between G2 and G3.

Now, let it be assumed that the selection key 840 is depressed (S3) for selection of "Undulate" in the display G2. By depression of the selection key 840, the operational mode is switched to an "undulating printing mode", whereby the screen display changes to G4. In undulating printing, it is possible to print a print image selectively in long undulations (see FIG. 5B) and in short undulations (see FIG. 5C), so that the cursor key 830 may be depressed (S4) for selecting either "Big Wave", i.e. printing in long undulations (G4) or "Small Wave", i.e. printing in short undulations (G5). In the illustrated example, it is assumed that "Big Wave" is selected (S5). If "Serrate" is selected in place of "Undulate" at the step S3, "Big Tooth", i.e. printing in deep serrations (see FIG. 5D) and "Small Tooth", i.e. printing in shallow serrations (see FIG. 5E) are displayed in the screen displays G4 and G5, respectively.

As described above, the tape printing apparatus allows the user to select a desired one out of the four kinds of modification patterns, i.e. "Big Wave", "Small Tooth", "Big Tooth", and "Small Tooth" and then print a character string image based on the selected pattern. Thus, modification pattern-selecting means of the invention is implemented by the keyboard 8, the display 9, and a program for forming and displaying the various modification patterns on the display screen 91 and enabling selection of a desired modification pattern.

If a desired modification pattern ("Big Wave" in the present case) is selected in the undulating printing mode (S5), the operational mode is switched to a "size correction-setting mode" which enables setting of correction of the character size of each character image, and a screen G6 is displayed. Size correction in the size correction-setting mode is performed in the case of part of a character string image extends off a printable area (print area) of the tape T in undulating or serrating printing of the character string (see FIGS. 5B to 5E), so as to reduce the size of the character images before the special printing is carried out, thereby preventing the character string image printed in special printing from extending off the print area of the tape T. Therefore, once size correction has been set, the character string image can be printed on the tape T without extending off the print area (see FIG. 8). In the size correction-setting mode, the cursor key 830 (S6) is operated to select between "on" (G6) for setting size correction and "off" (G7) for prohibiting size correction. In the illustrated example, it is assumed that "off" is selected (S7).

When "off" is selected in the size correction-setting mode (S7), the operational mode is switched to a "circulation-setting mode", and a screen G8 is displayed. The function of circulation to be set in the circulation-setting mode enables a portion of a character string image for undulation or serration which extends off one side of the print area of the tape T to be printed on an opposite side of the same. In short, the circulation function causes each portion of the character string image which lies out of the print area of the tape T to be moved to the opposite side portion of the print area with its orientation preserved, and printed on the tape T (see FIGS. 9A, 9B). In the circulation-setting mode, the cursor key (S8) is operated to select between "on" (G8) for setting the circulation and "off" (G9) for prohibiting the circulation.

On the other hand, if "on" is selected in the size correction-setting mode, the operational mode is switched not to the circulation-setting mode but to a "print execution mode", referred to hereinafter, and a screen G10 is displayed. When the size correction is set, a character string image is fitted in or adapted in size to the print area of the tape T, and hence the character string image printed on the tape T does not need the circulation. For this reason, when the size correction is set, the operational mode is switched directly to the "print execution mode". Thus, the size correction and the circulation are alternatively set.

When "on" or "off" is selected (S9) in the screen display G8 or G9, the operational mode is switched from the circulation-setting mode to the print execution mode, whereby the screen display G10 is displayed. The print execution mode is a mode for making a final decision as to whether or not printing should be executed. In this mode, it is possible to depress the cursor key 830 (S10) to thereby select between "EXECUTE" (G10) for permitting printing and "CANCEL" (Gll) for prohibiting printing. If "EXECUTE" is selected (S11), the character string image is printed on the tape T, based on the various setting described above.

Next, a process for forming a print image in "undulating printing" and "serrating printing" will be described in detail with reference to FIGS. 10A to 18. In these printing methods, data (basic image data) of a basic image, i.e. an image identical to one to be printed in normal printing is stored in the print buffer 244 of the RAM 240 in a manner developed or transformed into a dot matrix, and then respective dots forming the basic image are shifted based on a selected modification pattern to form a desired print image.

The print buffer 244 includes an area corresponding to the print area of the tape T, and the CPU 210 reads data associated with the basic image from the CG-ROM 230, etc., develops the data into a dot matrix, and stores the developed data in the print buffer 244. Therefore, data-developing means of the invention is implemented by the CPU 210, the print buffer 244, the CG-ROM 230, and a program for developing data into a dot matrix and storing the developed data in the print buffer 244.

Figure 10A:
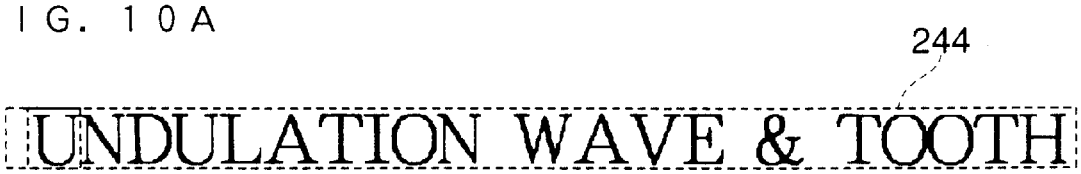
FIG. 10A imaginarily shows a character string image stored in a print buffer.
Figure 10B:
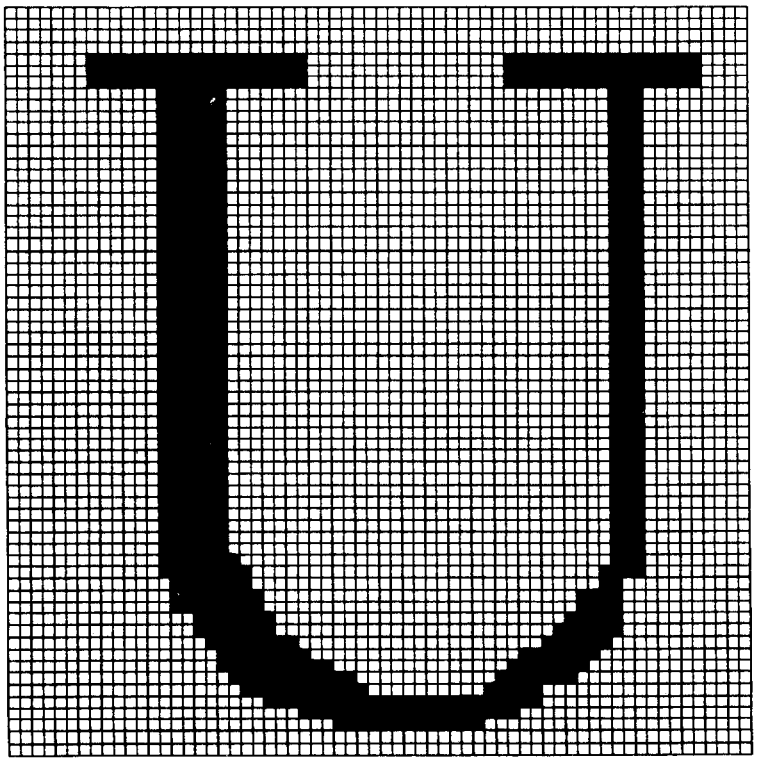
FIG. 10B shows part of the FIG. 10A character string image on an enlarged scale.

FIG. 10A imaginarily shows a basic image of the entered character string in a state stored in the print buffer 244, while FIG. 10B shows a character image of "U" of the character string on an enlarged scale. A print image in "undulating printing" or "serrating printing" is formed by shifting each dot of each dot line forming part of the basic image shown in FIG. 10B and extending in a direction corresponding to the direction of width of the tape T (vertical direction in FIG. 10A), in a direction along the dot line by a predetermined amount. Hereinafter, the amount of shifting of each dot of each dot line is referred to simply as "the shift amount".

Next, a method of calculating the shift amount will be described. First, in the case of "undulating printing", if the number of dots of the print buffer 244 aligned in the direction corresponding to the direction of width of the tape T (hereinafter referred to as "the width dot number") is represented by W, and numbers 1, 2, 3, . . . (hereinafter referred to as "the line numbers") sequentially assigned to the respective dot lines of the print buffer 244 each extending in the direction corresponding to the direction of width of the tape T, starting from a dot line at a forward end (left side end in FIG. 10A) of the print buffer 244 with respect to a direction corresponding to the direction of length of the tape T are generically represented by ln, the shift amount S for "Big Wave" printing and that for "Small Wave" printing can be calculated respectively by the use of the following equations 1 and 2:

$$S=(W/3)\sin\{(ln/8W)\times 2\pi\} \quad (1)$$

$$S=(W/4)\sin\{(ln/4W)\times 2\pi\} \quad (2)$$

The shift amounts S obtained from the equations 1 and 2 when the width dot number W is set to 64 are shown in the following tables 1 and 2, respectively.

TABLE 1

| Line Number ln | 1 | 2 | 3 | . . . | 127 | 128 | 129 | . . . |
|---|---|---|---|---|---|---|---|---|
| (ln/8W) × 2π | 0.012 | 0.024 | 0.037 | . . . | 1.559 | 1.571 | 1.583 | . . . |
| Sin{(ln/8W) × 2π} | 0.012 | 0.025 | 0.037 | . . . | 1.000 | 1.000 | 1.000 | . . . |
| (W/3)sin{(ln/8W) × 2π} | 0.261 | 0.524 | 0.785 | . . . | 21.33 | 21.33 | 21.33 | . . . |
| Shift Amount S (Dots) | 0 | 1 | 1 | . . . | 21 | 21 | 21 | . . . |
| Line Number ln | 255 | 256 | 257 | . . . | 383 | 384 | 385 | . . . |
| (ln/8W) × 2π | 3.129 | 3.142 | 3.154 | . . . | 4.700 | 4.712 | 4.725 | . . . |
| Sin{(ln/8W) × 2π} | 0.012 | 0.000 | −0.012 | . . . | −1.000 | −1.000 | −1.000 | . . . |
| (W/3)sin{(ln/8W) × 2π} | 0.262 | 0.000 | −0.262 | . . . | −21.33 | −21.33 | −21.33 | . . . |
| Shift Amount S (Dots) | 0 | 0 | 0 | . . . | −21 | −21 | −21 | . . . |
| Line Number ln | 511 | 512 | 513 | . . . | 639 | 640 | 641 | . . . |
| (ln/8W) × 2π | 6.271 | 6.283 | 6.295 | . . . | 7.842 | 7.854 | 7.866 | . . . |
| Sin{(ln/8W) × 2π} | −0.012 | 0.000 | 0.012 | . . . | 1.000 | 1.000 | 1.000 | . . . |
| (W/3)sin{(ln/8W) × 2π} | −0.262 | 0.000 | 0.262 | . . . | 21.33 | 21.33 | 21.33 | . . . |
| Shift Amount S (Dots) | 0 | 0 | 0 | . . . | 21 | 21 | 21 | . . . |

W = 64

TABLE 2

| Line Number ln | 1 | 2 | 3 | . . . | 63 | 64 | 65 | . . . |
|---|---|---|---|---|---|---|---|---|
| (ln/8W) × 2π | 0.025 | 0.049 | 0.074 | . . . | 1.546 | 1.571 | 1.595 | . . . |
| Sin{(ln/8W) × 2π} | 0.025 | 0.049 | 0.074 | . . . | 1.000 | 1.000 | 1.000 | . . . |

TABLE 2-continued

| | | | | | | | | |
|---|---|---|---|---|---|---|---|---|
| (W/3)sin{(ln/8W) × 2π} | 0.393 | 0.785 | 1.177 | . . . | 16.00 | 16.00 | 16.00 | . . . |
| Shift Amount S (Dots) | 0 | 1 | 1 | . . . | 16 | 16 | 16 | . . . |
| Line Number ln | 127 | 128 | 129 | . . . | 191 | 192 | 193 | . . . |
| (ln/8W) × 2π | 3.117 | 3.142 | 3.166 | . . . | 4.688 | 4.712 | 4.737 | . . . |
| Sin{(ln/8W) × 2π} | 0.025 | 0.000 | −0.025 | . . . | −1.000 | −1.000 | −1.000 | . . . |
| (W/3)sin{(ln/8W) × 2π} | 0.393 | 0.000 | −0.393 | . . . | −16.00 | −16.00 | −16.00 | . . . |
| Shift Amount S (Dots) | 0 | 0 | 0 | . . . | −16 | −16 | −16 | . . . |
| Line Number ln | 255 | 256 | 257 | . . . | 319 | 320 | 321 | . . . |
| (ln/8W) × 2π | 6.259 | 6.283 | 6.308 | . . . | 7.829 | 7.854 | 7.879 | . . . |
| Sin{(ln/8W) × 2π} | −0.025 | 0.000 | 0.025 | . . . | 1.000 | 1.000 | 1.000 | . . . |
| (W/3)sin{(ln/8W) × 2π} | −0.393 | 0.000 | 0.393 | . . . | 16.00 | 16.00 | 16.00 | . . . |
| Shift Amount S (Dots) | 0 | 0 | 0 | . . . | 16 | 16 | 16 | . . . |

W = 64

Line numbers in values of which are actually shown in the table 1 or 2 are ones whose shift amounts S are equal to "0", the maximum, and the minimum, as well as ones immediately before and after these line numbers ln. The shift amount S is obtained by rounding off a result of calculation by the use of the equation (1) or 2. When the shift amount S is positive, each dot of each dot line shown in FIG. 10B is shifted upward, whereas when the shift amount S is negative, each dot is shifted downward.

As shown by the equations 1, 2 and the tables 1, 2, the shift amounts S are each calculated by the use of the equation including a sine function, and hence the shift amount S increases or decreases according to the sine function. Therefore, if each dot of each dot line forming part of the basic image is shifted according to the calculated shift amount, the basic image is deformed to be undulated in the direction of width of the tape T, based on a sine curve, whereby a print image for undulating printing is formed. It should be noted that a data table defining values of the shift amount on a dot line-by-dot line basis may be searched to obtain the shift amount S instead of calculating the sine function by the equation (1) or 2. This makes it possible to speed up calculation of the shift amount S.

On the other hand, in the case of "serrating printing", the shift amount S for "Big Tooth" printing and that for "Small Tooth" printing can be calculated, respectively, e.g. by the use of the following equations 3 and 4:

$$S=\mathrm{mod}\{ln/(W/4)\}\times\mathrm{mod}[\{\mathrm{int}(ln/(W/4))+1\}/2]+[(W/4)-\mathrm{mod}\{ln/(W/4)\}]\times\mathrm{mod}[\mathrm{int}\{ln/(W/4)\}/2] \quad (3)$$

where "mod" represents a remainder resulting from a division within the following brace or bracket, and "int" a quotient obtained by a division within the following brace or bracket. The symbols "mod" and "int" in the equation (4) also represent a remainder and a quotient, respectively.

$$S=\mathrm{mod}\{ln/(W/8)\}\times\mathrm{mod}[\{\mathrm{int}(ln/(W/8))+1\}/2]+[(W/8)-\mathrm{mod}\{ln/(W/8)\}]\times\mathrm{mod}\ [\mathrm{int}\{ln/(W/8)\}/2] \quad (4)$$

The shift amounts S obtained from the equations 3 and 4 when the width dot number W is set to 64 are shown in the following tables 3 and 4, respectively. In the tables 3 and 4, line numbers ln values of which are actually shown in the table 1 or 2 are ones whose shift amounts S are equal to "0", the maximum, and the minimum, as well as ones immediately before and after these line numbers ln.

TABLE 3

| Line Number ln | 1 | 2 | 3 | . . . | 15 | 16 | 17 | . . . | 31 | 32 | 33 | . . . | 47 | 48 | 49 | . . . | 63 | 64 | 65 | . . . |
|---|---|---|---|---|---|---|---|---|---|---|---|---|---|---|---|---|---|---|---|---|
| α: mod{ln/(W/4)} | 1 | 2 | 3 | . . . | 15 | 0 | 1 | . . . | 15 | 0 | 1 | . . . | 15 | 0 | 1 | . . . | 15 | 0 | 1 | . . . |
| β: mod[{int(ln/(W/4)) + 1}/2] | 1 | 1 | 1 | . . . | 1 | 0 | 0 | . . . | 0 | 1 | 1 | . . . | 1 | 0 | 0 | . . . | 0 | 1 | 1 | . . . |
| γ: [(W/4) − mod{ln/(W/4)}] | 15 | 14 | 13 | . . . | 1 | 16 | 15 | . . . | 1 | 16 | 15 | . . . | 1 | 16 | 15 | . . . | 1 | 16 | 15 | . . . |
| δ: mod[int{ln/(W/4)}/2] | 0 | 0 | 0 | . . . | 0 | 1 | 1 | . . . | 1 | 0 | 0 | . . . | 0 | 1 | 1 | . . . | 1 | 0 | 0 | . . . |
| Shift Amount S (Dots) α × β + γ × δ | 1 | 2 | 3 | . . . | 15 | 16 | 15 | . . . | 1 | 0 | 1 | . . . | 15 | 16 | 15 | . . . | 1 | 0 | 1 | . . . |

W = 64

TABLE 4

| Line Number ln | 1 | 2 | 3 | . . . | 7 | 8 | 9 | . . . | 15 | 16 | 17 | . . . | 23 | 24 | 25 | . . . | 31 | 32 | 33 | . . . |
|---|---|---|---|---|---|---|---|---|---|---|---|---|---|---|---|---|---|---|---|---|
| α: mod{ln/(W/4)} | 1 | 2 | 3 | ... | 7 | 0 | 1 | . . . | 7 | 0 | 1 | . . . | 7 | 0 | 1 | . . . | 7 | 0 | 1 | . . . |
| β: mod[{int(ln/(W/4)) + 1}/2] | 1 | 1 | 1 | ... | 0 | 1 | 1 | . . . | 0 | 1 | 1 | . . . | 1 | 0 | 0 | . . . | 0 | 1 | 1 | . . . |
| γ: [(W/4) − mod{ln/(W/4)}] | 7 | 6 | 5 | ... | 1 | 8 | 7 | . . . | 1 | 8 | 7 | . . . | 1 | 8 | 7 | . . . | 1 | 8 | 7 | . . . |

TABLE 4-continued

| Line Number ln | 1 | 2 | 3 | ... | 7 | 8 | 9 | ... | 15 | 16 | 17 | ... | 23 | 24 | 25 | ... | 31 | 32 | 33 | ... |
|---|---|---|---|---|---|---|---|---|---|---|---|---|---|---|---|---|---|---|---|---|
| δ: mod[int{ln/(W/4)}/2] | 0 | 0 | 0 | ... | 0 | 1 | 1 | ... | 1 | 0 | 0 | ... | 0 | 1 | 1 | ... | 1 | 0 | 0 | ... |
| Shift Amount S (Dots) $\alpha \times \beta + \gamma \times \delta$ | 1 | 2 | 3 | ... | 7 | 8 | 7 | ... | 1 | 0 | 1 | ... | 7 | 8 | 7 | ... | 1 | 0 | 1 | ... |

W = 64

As shown by the equations 3, 4 and the tables 3, 4, each of the equations for calculating the shift amount S for "serrating printing" has a right side including a first term from which a continuously increasing shift amount S is obtained ($\alpha \times \beta$: see the tables 3, 4) and a second term from which a continuously decreasing shift amount S is obtained ($\gamma \times \delta$: see the tables 3, 4). Further, the expression β of the first term and the expression δ of the second term each assume "0" or "1" depending on the line number ln, whereby the values of the first and second terms are alternately reflected in the shift amount S. Therefore, calculation by combination of the first and second terms makes it possible to obtain a print image formed by serrating the basic image. The above equations (1), (2), (3) and (4) are stored in advance in the ROM 220 (modification pattern storage means) as shift amount-calculating programs. In short, these equations (1), (2), (3) and (4) define the four modification patterns "Big Wave", "Small Wave", "Big Tooth" and "Small Tooth" referred to hereinabove.

Figure 11:
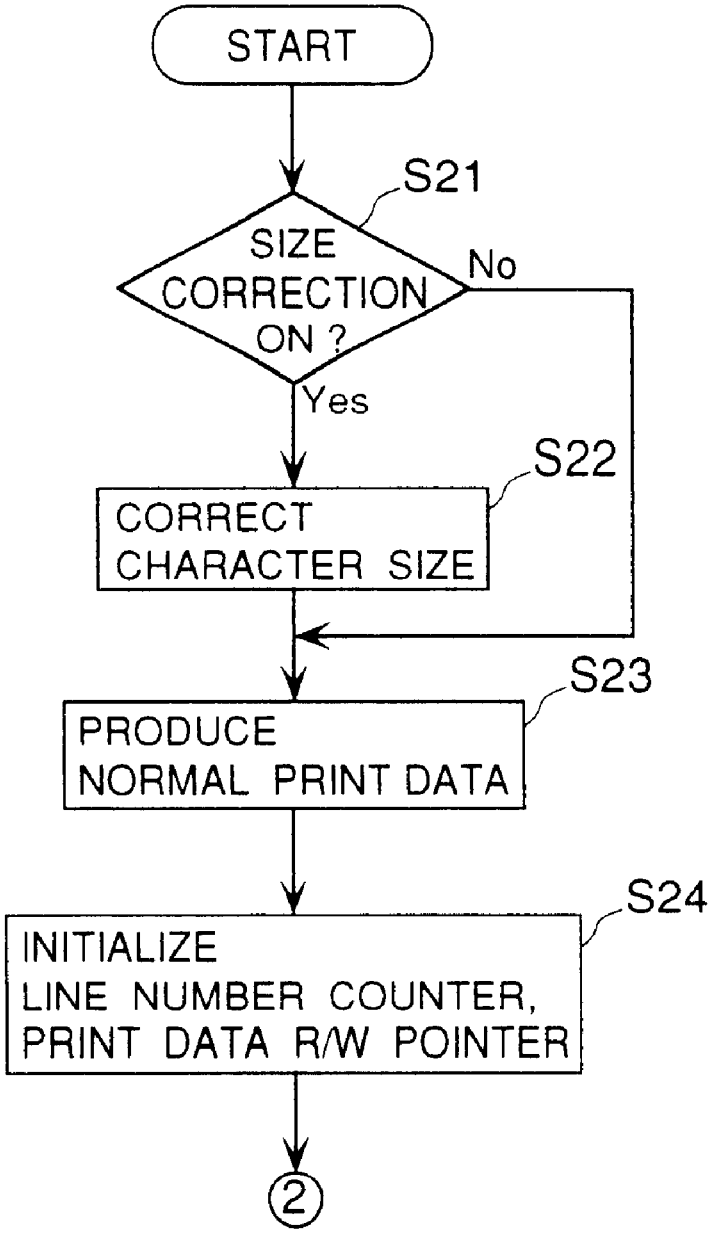
FIG. 11 is a flowchart showing a routine for internal processing and print processing executed in special printing.

Next, description will be made of internal processing executed by the control block 200 for forming a print image and print processing executed based on the internal processing, with reference to FIGS. 11 and 12. When "EXECUTE" of special printing is selected at S11 in FIG. 7, it is determined at a step S21 whether or not the size correction is set. If the size correction is set (Yes to S21), the basic image is scaled down or decreased in size at a step S22 to prevent the basic image from spreading beyond the print area of the tape T when the dots of all the dot lines are shifted based on any one of the modification patterns.

More specifically, the basic image is scaled down such that the maximum number of dots of the basic image along the direction corresponding to the direction of width of the tape T (i.e. the number of dots between an upper end of the basic image and a lower end of the same) becomes smaller than a value obtained by subtracting a maximum value of the shift amount S from the width dot number W of the print buffer 244. In the case of "undulating printing", it often happens that the shift amount S becomes negative, so that the maximum value of the shift amount S is obtained by adding the shift amount of dots shifted upward and that of dots shifted downward. Therefore, e.g. when the "Big Wave" printing is selected, the maximum value of the shift amount calculated based on the table 1 is equal to 42 (=21+21) dots.

In general, a basic image can be scaled down by thinning out the dots of each dot line extending in the direction corresponding to the direction of width of the tape, by a predetermined number of dots. Further, when a basic image is formed only by a character string image as in the present embodiment, the basic image may be scaled down by changing the size of the characters to a smaller one.

Thereafter, the basic image data is stored in the print buffer 244, and print data of the same kind as used in normal printing is produced at a step S23.

Then, at a step S24, a line number counter for counting the line number ln and a print data R/W pointer for designating an address of a predetermined dot line in the print buffer 244 and reading and writing data associated with the dot line are each initialized. More specifically, a certain variable is defined as a line number counter, and "0" is assigned to the variable. Similarly, a certain variable is defined as a print data R/W pointer, and this variable is set such that an address of the first dot line (dot line number ln=1) in the print buffer 244 can be designated by the variable.

Figure 12:
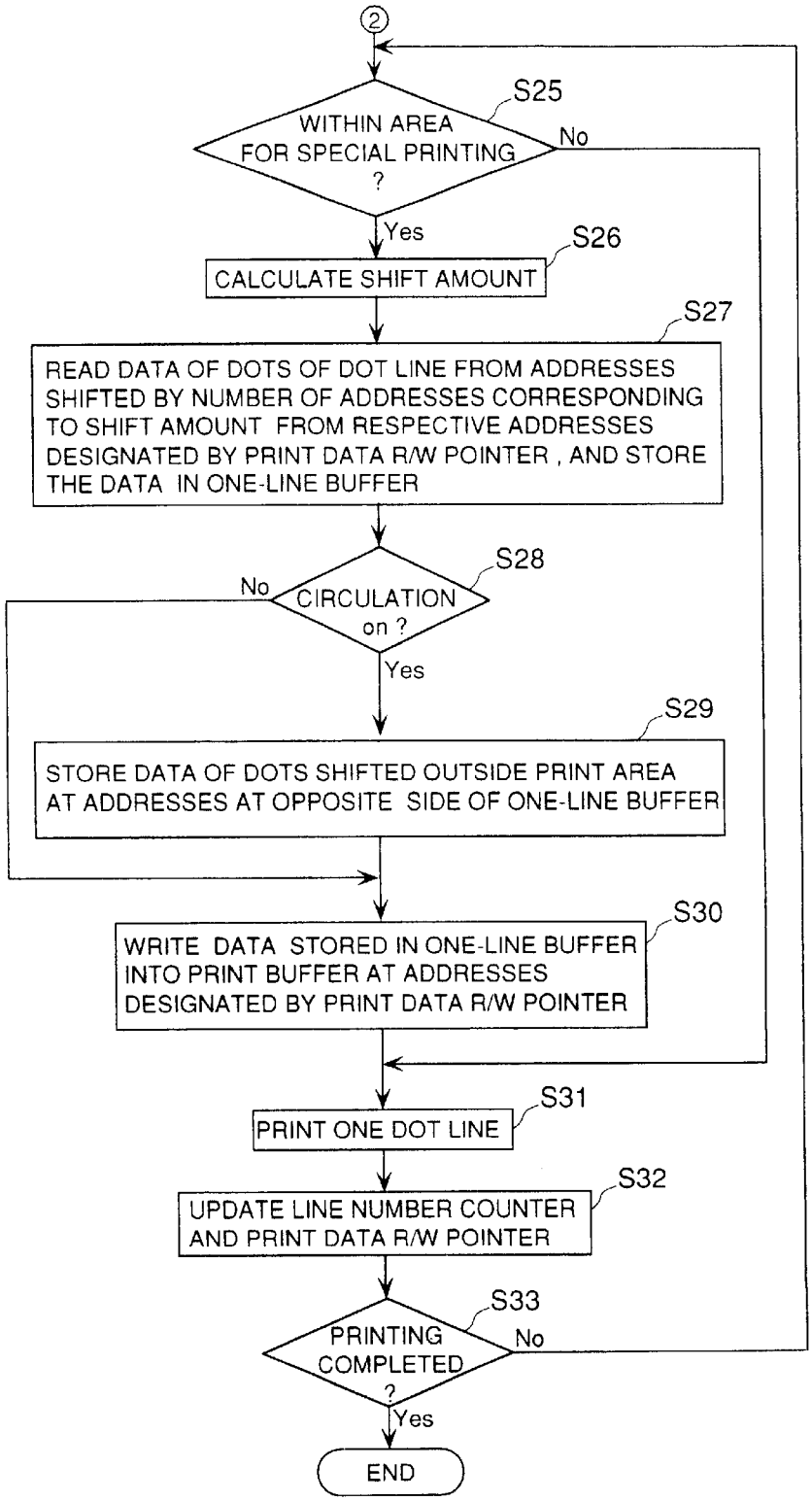
FIG. 12 is a continued part of the FIG. 11 flowchart.
Figure 13:
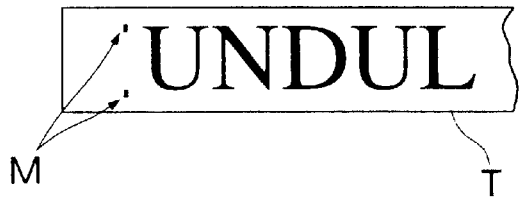
FIG. 13 is a plan view of a tape having cut marks printed thereon.

Then, as shown in FIG. 12, it is determined at a step S25 whether or not a dot line having an address actually designated by the print data R/W pointer is within an area permitting special printing, i.e. "undulating printing" or "serrating printing". More specifically, print data is stored in the print buffer 244 in view of lengths of respective margins between a print image to be printed and an extreme forward end and between the print image and an extreme backward end of a label, so that at the step S25, it is determined by the use of the line number whether or not the dot line having the address designated by the print data R/W pointer is within a margin. Since a dot line in such a margin has no dots to be shifted, the dot line is judged to be out of the area permitting special printing (No to S25), and the shift amount associated with the dot line is not calculated.

The tape printing apparatus 1 allows the user to set the margin lengths freely. However, if the length of the margin on the forward end side of the tape is set to an extremely small value (e.g. approximately 1 mm), the distance between the print head 46 and the tape cutter 131 does not allow the tape T to be automatically cut such that the tape T can have the margin. For this reason, a pair of cut marks M, M are printed in upper and lower portions of the tape T along the width thereof, respectively, so as to inform the user of an imaginary cutoff line. That is, when the user cuts the tape T e.g. by scissors along the imaginary cutoff line extending through the cut marks M, M, a margin having a length set by the user is formed on the forward end side of the tape T.

In an identical dot line in the print buffer 244, there is stored positive dot data of several dots required for printing the cut marks M, M on the tape T. If the dots forming the cut mark M are shifted, they are likely to be moved out of the tape T, forming no cut mark M. Therefore, the dot line having the cut marks M, M is also placed out of the area permitting special printing, whereby the dots of the dot line are prevented from being shifted (No to S25).

If it is determined that the dot line is within the area permitting special printing (Yes to S25), the shift amount S is calculated at a step S26 by the use of the line number ln and one of the equations 1 to 4 which corresponds to a desired modification pattern. Then, at a step S27, data of the dot line at locations (addresses) designated by the print data R/W pointer are read from respective locations (addresses) displaced by the calculated shift amount S in a direction opposite to a shifting direction, and stored in the one-line buffer 245 having the same capacity as one dot line.

Figure 14:
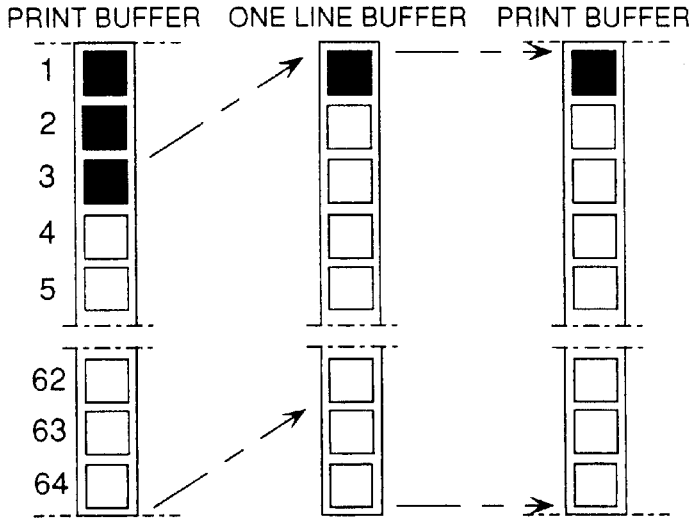
FIG. 14 is a diagram which is useful in explaining sequential processes of reading and writing of data in the print buffer.

When the circulation has not been set in the circulation-setting mode (No to S28), the data stored in the one-line buffer 245 are written into the print buffer 244 at the addresses designated by the print data R/W pointer at a step S30. FIG. 14 schematically shows the sequential processes executed at steps S27, S28 and S30 when the shift amount is set to 2 dots. As shown in the figure, data items of a third dot from the top of the dot line in the print buffer 244 and dots subsequent thereto of the same dot line are designated by the print data R/W pointer and stored in the one-line buffer 245 in a manner arranged in sequence from the top of the one-line buffer 245. Then, at the step S30, the data items are written into the print buffer 244 at the addresses designated by the print data R/W pointer in a manner arranged in sequence from the top of the print buffer 244. In each of last two dots of the one-line buffer 245 is stored a value (e.g. NULL) indicating that there is no data. Thus, when the circulation is not set, the data extending off the print area (in the case of the illustrated example, the data of the first and second dots of the dot line from the upper end thereof as viewed in FIG. 14, which is originally stored in the print buffer 244), is discarded or not printed.

Figure 15:
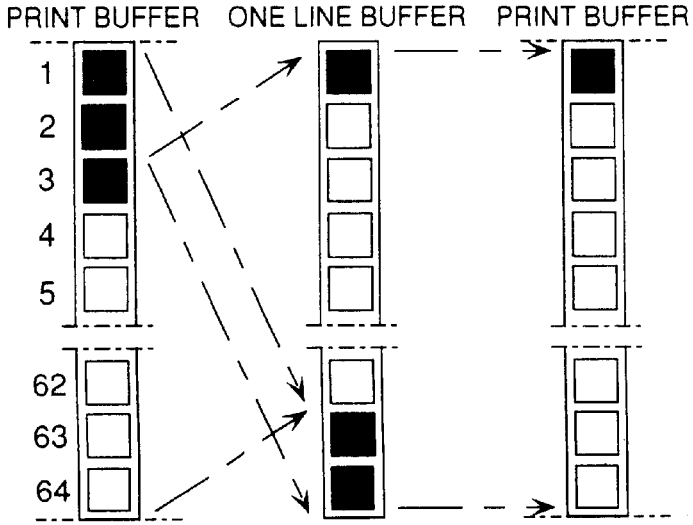
FIG. 15 is a diagram which is useful in explaining sequential processes of reading and writing of data in the print buffer, executed when the circulation is set.

On the other hand, when the circulation has been set in the circulation-setting mode (Yes to S28), dots of each dot line in the print buffer 244 are shifted circularly in a state of both ends of the dot line being imaginarily linked to each other. More specifically, at a step S29, the data of the dot line at the addresses designated by the print data R/W pointer are read from respective locations displaced by the calculated shift amount S in the direction opposite to the shifting direction, and stored in the one-line buffer 245. At the same time, data of dots displaced from the print area due to the shifting are stored in an opposite end portion (bottom end portion in the illustrated example) of the one-line buffer 245. Then, at the following step S30, the data stored in the one-line buffer 245 are written into the print buffer 244 at the address designated by the print data R/W pointer. FIG. 15 schematically shows sequential processes executed at the steps S27, S28, S29 and S30 when the shift amount is set to 2 dots similarly to the case in FIG. 14. Differently from the case in which circulation has not been set, the data items of the two displaced dots are stored in the last two elements of the one-line buffer 245 in each of which the NULL value would be stored if the circulation were not set. Thereafter, at the step S30, the data stored in the one-line buffer are written into the print buffer 244 at the addresses designated by the print data R/W pointer.

Then, the dot line data, i.e. one dot line (one line) of data, written into the print buffer 244 from the one-line buffer 245 are printed on the tape T via the print head 46 at a step S31. Thereafter, the line number counter and the print data R/W pointer are updated respectively at the following step S32 such that the line number counter is incremented by 1, and the print data R/W pointer designates the following next set of addresses.

Figure 16A:
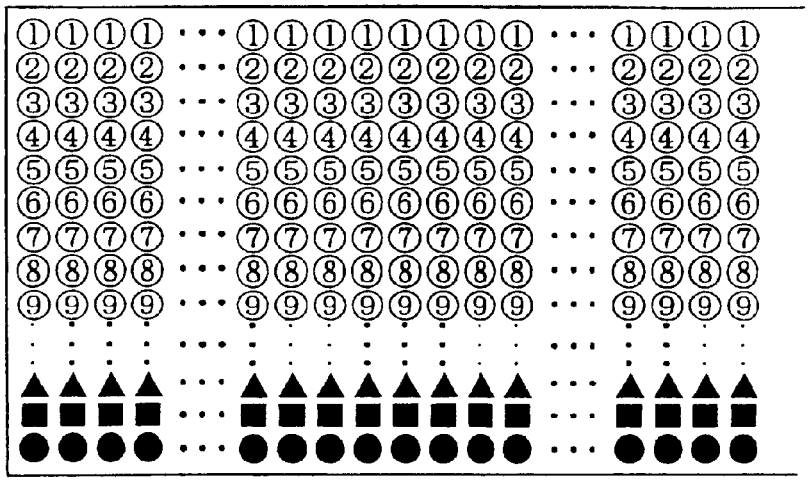
FIG. 16A is a diagram which is useful in explaining shifts of dots of each dot line in normal printing.
Figure 16B:
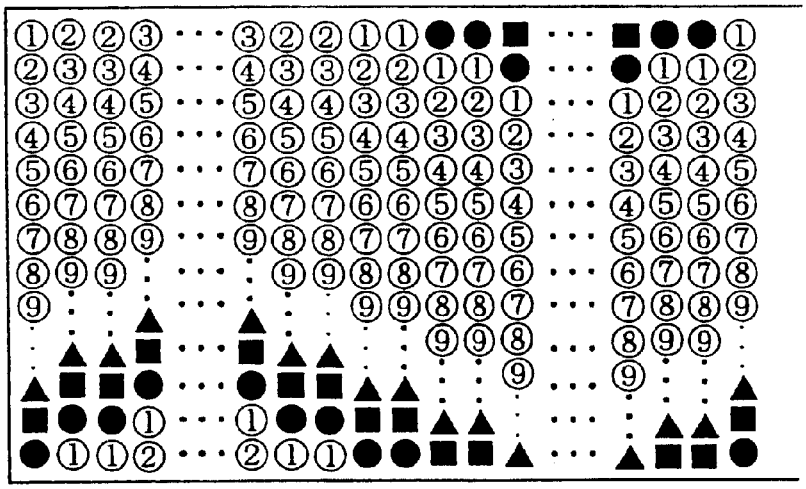
FIG. 16B is a diagram which is useful in explaining shifts of dots of each dot line in undulating printing.
Figure 17:
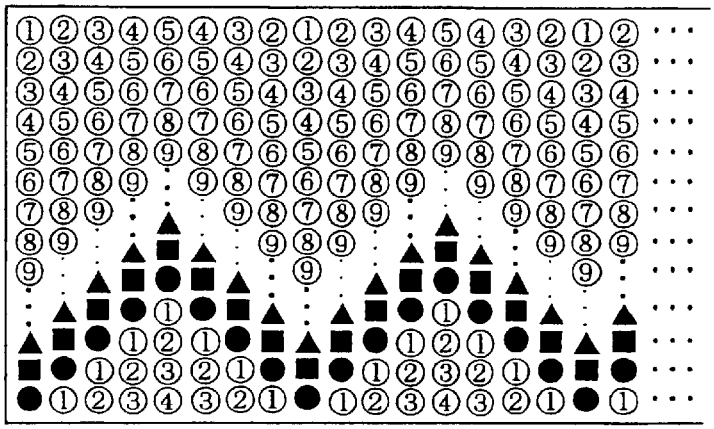
FIG. 17 is a diagram which is useful in explaining shifts of dots of each dot line in serrating printing.

The above processing from the steps S25 to S32 is executed repeatedly, whereby the print image is formed and printed on the tape T on a dot line-by-dot line basis. FIG. 16A schematically shows a shift of each dot line in normal printing, while FIG. 16B shows one in undulating printing. The undulating printing in FIG. 16B is carried out without using any one of the above equations. Similarly, FIG. 17 schematically shows a shift of each dot of each dot line in serrating printing. As shown in the figure, each dot of the each dot line is shifted based on the shift amount S, and then the dot lines are printed on the tape T on a line-by-line basis. Then, when printing of a last one of the dot lines forming the print image is completed (Yes to S33), the internal processing is terminated, and a label bearing the print image obtained by undulating or serrating the basic image (see FIGS. 5B to 5E, 8 and 9) is produced.

Figure 18:
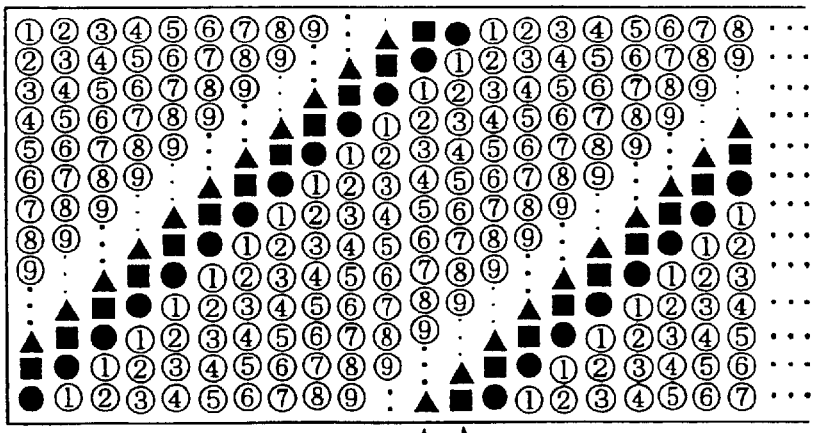
FIG. 18 is a diagram which is useful in explaining how each dot of each dot line is shifted when a shift amount is set to be continuously increased.

Although detailed description is omitted, the equations for calculating the shift amount S can be altered as required, to shift each dot of each dot line according to a continuously increasing shift amount S as shown in FIG. 18.

Figure 19:
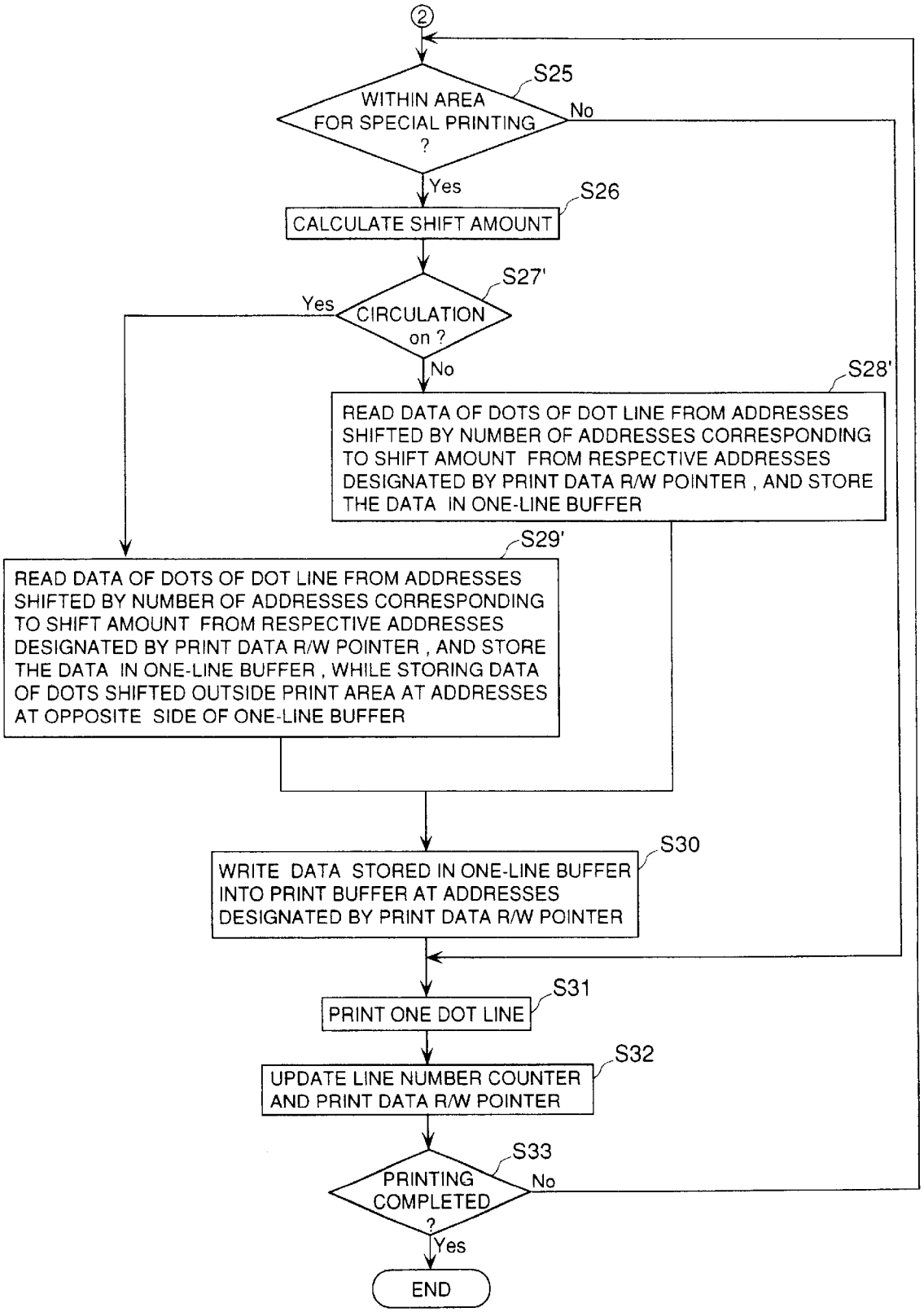
FIG. 19 is a flowchart of a variation of the embodiment which corresponds to the FIG. 12 flowchart.

It should be noted that as a variation of the above embodiment, the flow of the print process shown in the FIG. 12 flowchart may be changed, as shown in FIG. 19, such that immediately after the calculation of the shift amount (S26), the determination as to the setting of the circulation may be carried out at a step S27', and depending on the result of the determination, the program proceeds to a step S28', wherein the print data is stored in the one-line buffer 245 by discarding data extending off the print area, or to a step S29', wherein the print data is stored in the one-line buffer while also storing the data extending off the print area at an opposite side of the one-line buffer.

As described above, the present invention makes it possible to shift each dot of each dot line forming part of a basic image in the direction along the dot line based on a desired modification pattern, to thereby form a print image deformed in the direction of width of a tape, enabling creation of labels richer in variety than conventional ones.

Figure 20:
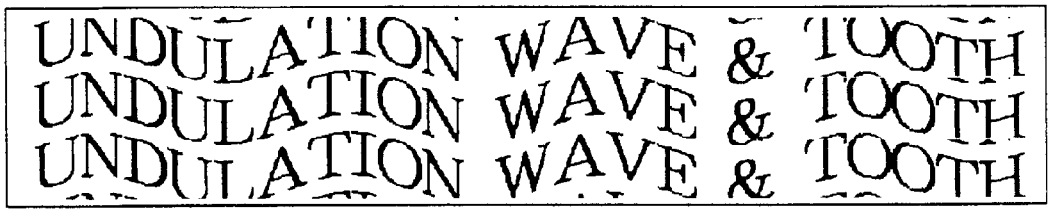
FIG. 20 is a plan view showing a plurality of labels produced after setting of the circulation and placed in a manner continuous with each other.

Further, since size correction can be set before forming a print image, the print image is prevented from spreading beyond the print area of the tape T, and hence a good-looking label can be produced. Still further, the circulation can be set before forming a print image, so that even if part of a character string image or the like is displaced from the print area of the tape T, one or more displaced portions can be each printed as a print image in a predetermined portion of the print area, which makes it possible to recognize the original character string image. Moreover, as shown in FIG. 20, if a plurality (three in the figure) of labels made after the setting of the circulation are placed in a manner continuous with each other in the direction of width of the tape, each displaced portion of a print image on a label is complemented by a corresponding portion of the print image printed on an adjacent label. Therefore, it is possible to make a label having thereon the identical print images printed parallel to each other in the direction of width of the tape.

Figure 21A:
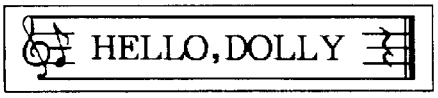
FIG. 21A is a plan view showing an example of a label produced by normal printing.
Figure 21B:
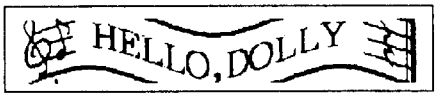
FIG. 21B is a plan view showing an example of a label produced by undulating printing.
Figure 22A:
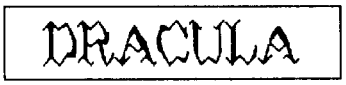
FIGS. 22A and 22B are plan views each showing an example of a label produced by serrating printing.
Figure 22B:
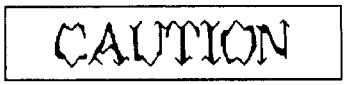

Another advantage of the invention concerns printing of e.g. an image having a song title enclosed by a staff as an outer frame. If the image is printed in normal printing, a label as shown in FIG. 21A is produced. On the other hand, if the identical image is printed in "undulating printing", the created label can give a melodious impression (see FIG. 21B). Further, if a character string image containing a horrifying word, such as "Dracula", is printed in "serrating printing", it is possible to make a label giving a fearful impression (see 21A). Similarly, if a character string "CAUTION" is printed in "serrating printing", it is possible to make a label giving a feeling of danger of electric shock (see FIG. 22B).

Although in the present embodiment, the equations 1 to 4 are used for calculating the shift amount, this is not limitative, but any other equation may be used so long as it can be used for shifting the dots of respective dot lines in a direction corresponding to the direction of width of a tape. Further, the maximum shift amount of each dot may be preset according to the width of the tape. In this case, it is possible to form a print image having a proper size according to the difference in width of each type of tape. Further, although in the print processing of the embodiment, the dot lines in the print buffer are subjected to printing and shift processing on a line-by-line basis, the data in the print buffer may be printed in a single operation after the shift processing has been executed for all the dot lines.

Still further, although in the embodiment, the character string image is formed as a print image, this is not limitative, but the invention can be applied to cases where print images of various kinds of images such as graphics and pictures are formed.

Moreover, in the embodiment, each dot of each dot line extending in the direction corresponding to the direction along the width of the tape is shifted in the direction along the dot line. However, each dot of each dot line orthogonal to the above dot lines, i.e. each dot of each dot line extending in a direction corresponding to the direction of length of the tape may be shifted in the direction along the dot line. In this case, the basic image is deformed in the direction of length of the tape to form a print image.

It is further understood by those skilled in the art that the foregoing is a preferred embodiment of the invention, and that various changes and modifications may be made without departing from the spirit and scope thereof.

What is claimed is:

1. A tape printing apparatus for deforming a basic image in a direction of width of a tape, based on a specific modification pattern, and then printing the deformed basic image on said tape, the tape printing apparatus comprising:

modification pattern storage means for storing modifying data of said modification pattern;

data-developing means for developing basic image data representative of said basic image into a dot matrix corresponding to a print area of said tape; and print image-forming means for forming a print image from said basic image by shifting each dot of each dot line of said basic image data developed into said dot matrix, said each dot line extending in a direction corresponding to said direction of said width of said tape, in said direction corresponding to said direction of said width of said tape, based on said modification pattern.

2. A tape printing apparatus according to claim 1, wherein said print image-forming means includes image correction means for scaling down said basic image, said image correction means scaling down said basic image in a manner such that said print image is fitted in said print area if said print image extends off said print area of said tape.

3. A tape printing apparatus according to claim 1, wherein said print image-forming means includes dot-shifting means for shifting said each dot of each dot line of said dot matrix in a state of both ends of said each dot line being imaginarily linked to each other, said data-shifting means circularly moving dots forming portions of said print image outside said print area of said tape if said print image extends off said print area.

4. A tape printing apparatus according to claim 1, wherein said print image-forming means includes image correction means for scaling down said basic image, said image correction means scaling down said basic image in a manner such that said print image is fitted in said print area if said print image extends off said print area of said tape, and dot-shifting means for shifting said each dot of each dot line of said dot matrix in a state of both ends of said each dot line being imaginarily linked to each other, said data-shifting means circularly moving dots forming portions of said print image outside said print area of said tape if said print image extends off said print area, and wherein said tape printing apparatus includes function selection means for selecting between an image-correcting function performed by said image correction means and a dot-shifting function performed by said dot-shifting means.

5. A tape printing apparatus according to claim 1, 2 or 3, wherein said modification pattern storage means stores modifying data of a plurality of modification patterns, the tape printing apparatus further including modification pattern selection means for selecting said specific modification pattern from said modification patterns as desired.

6. A tape printing apparatus according to claim 5, wherein said modification patterns include a pattern for deforming the whole of said basic image into a wavy shape in which said basic image is undulated in said direction of said width of said tape.

7. A tape printing apparatus according to claim 5, wherein said modification patterns include a pattern for deforming the whole of said basic image into a sawtooth shape in which said basic image is serrated in said direction of width of said tape.

8. A tape printing apparatus according to claim 1, 2 or 3, wherein said modifying data includes data of a maximum total shift amount by which said basic image is shifted as a whole.

9. A tape printing apparatus according to claim 8, wherein said maximum total shift amount is set according to said width of said tape.

10. A tape printing apparatus according to claim 1, wherein said modifying data comprises data defining a shift amount by which said each dot of said each dot line is shifted in said direction corresponding to said direction of said width of said tape.

11. A tape printing apparatus according to claim 10, wherein said data defining said shift amount comprises an equation for calculating said shift amount for said each dot line.

12. A tape printing apparatus according to claim 10, wherein said data defining said shift amount comprises a table of data of said shift amount associated with said each dot line of said basic image data.

13. A tape printing apparatus according to claim 10, wherein said data-developing means comprises a print buffer for storing data of said each dot of said each dot line of said basic image, and wherein said print image-forming means comprises reading means for reading said data of said each dot from an address of said print buffer shifted from an original address in an amount corresponding to said shift amount, and a modifying buffer for storing said data of said each dot read from said address of said print buffer by said reading means.

14. A method of forming a print image to be printed on a tape by deforming a basic image in a direction of width of a tape, based on a specific modification pattern, the method comprising the steps of:

storing modifying data of said modification pattern;

developing basic image data representative of said basic image into a dot matrix corresponding to a print area of said tape; and shifting each dot of each dot line of said basic image data developed into said dot matrix, said each dot line extending in a direction corresponding to said direction of said width of said tape, in said direction corresponding to said direction of said width of said tape, based on said specific modification pattern stored, to thereby form said print image from said basic image.

* * * * *